US010749264B2

(12) United States Patent
Niakan et al.

(10) Patent No.: US 10,749,264 B2
(45) Date of Patent: Aug. 18, 2020

(54) CAVITY-BACKED SLOT ANTENNA

(71) Applicant: Microsoft Technology Licensing, LLC, Redmond, WA (US)

(72) Inventors: Nahal Niakan, Issaquah, WA (US); Sean Russell Mercer, Issaquah, WA (US); Toby James Morris, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 280 days.

(21) Appl. No.: 15/783,729

(22) Filed: Oct. 13, 2017

(65) Prior Publication Data

US 2018/0294576 A1 Oct. 11, 2018

Related U.S. Application Data

(60) Provisional application No. 62/483,153, filed on Apr. 7, 2017.

(51) Int. Cl.

| | |
|---|---|
| ***H01Q 13/18*** | (2006.01) |
| ***H01Q 13/10*** | (2006.01) |
| ***H01Q 1/22*** | (2006.01) |
| ***H01Q 1/24*** | (2006.01) |
| *H01Q 1/48* | (2006.01) |
| *H01Q 1/38* | (2006.01) |

(52) U.S. Cl.

CPC ..... *H01Q 13/18* (2013.01); *H01Q 1/2258* (2013.01); *H01Q 1/243* (2013.01); *H01Q 13/103* (2013.01); *H01Q 1/38* (2013.01); *H01Q 1/48* (2013.01); *H01Q 13/106* (2013.01)

(58) Field of Classification Search

CPC ..... H01Q 13/18; H01Q 1/2258; H01Q 1/243; H01Q 13/103; H01Q 1/38; H01Q 1/48; H01Q 13/106

See application file for complete search history.

(56) References Cited

U.S. PATENT DOCUMENTS

| | | | | |
|---|---|---|---|---|
| 4,409,595 | A * | 10/1983 | Park | H01Q 21/0043 343/771 |
| 8,599,089 | B2 | 12/2013 | Bevelacqua et al. | |
| 9,450,292 | B2 | 9/2016 | Irci et al. | |
| 2011/0006953 | A1* | 1/2011 | Chiang | G06F 1/1616 343/702 |
| 2011/0050509 | A1 | 3/2011 | Ayala Vazquez et al. | |

(Continued)

OTHER PUBLICATIONS

Das, et al., "Estimation of Slot Position for a Slotted Antenna", In Proceedings of Computational Advancement in Communication Circuits and Systems, 2015, pp. 11-18.

(Continued)

*Primary Examiner* — Dameon E Levi
*Assistant Examiner* — David E Lotter
(74) *Attorney, Agent, or Firm* — Holzer Patel Brennan

(57) ABSTRACT

A cavity-backed slot antenna is disclosed that includes a stripline. The stripline includes a conductive strip between two ground planes separated by a dielectric. The conductive strip feeds the cavity-backed slot antenna. The stripline also includes a first segment and a second segment. The first segment has a first characteristic impedance. The second segment is proximate the cavity-backed antenna and has a second characteristic impedance different than the first characteristic impedance. The second characteristic impedance provides impedance for matching a load impedance of the cavity-backed slot antenna.

19 Claims, 29 Drawing Sheets

(56) References Cited

U.S. PATENT DOCUMENTS

| | | | | |
|---|---|---|---|---|
| 2011/0241943 | A1* | 10/2011 | Shiu | B23K 1/0016 343/700 MS |
| 2011/0241948 | A1* | 10/2011 | Bevelacqua | H01Q 1/243 343/702 |
| 2011/0285606 | A1 | 11/2011 | De Graauw et al. | |
| 2016/0190704 | A1* | 6/2016 | Celik | H01Q 15/0086 343/700 MS |
| 2018/0034159 | A1* | 2/2018 | Dumanli Oktar | A61B 5/0031 |

OTHER PUBLICATIONS

Hong, et al., "Size Reduction of Cavity-Backed Slot Antennas", In Proceedings of IEEE Transactions on Antennas and Propagation, vol. 54, No. 5, May 2006, pp. 1461-1466.

Jaheen, et al., "Slot Loaded Square Microstrip Patch Antenna for Dual Band Operation", In Journal of Electrical and Electronic Engineering, vol. 6, Issue 1, Jun. 2016, pp. 11-17.

Paryani, Rajesh, "Design of a Wideband Dual-polarized Cavity Backed Slot Antenna", In Electronic Theses and Dissertations of University of Central Florida, 2010, 86 Pages.

Shan, et al., "A Compact Broadband Stripline-fed Slot Antenna for Array Application", In Proceedings of IEEE International Workshop on Small Antennas and Novel Metamaterials, vol. 19, No. 1, Mar. 7, 2005, pp. 20-21.

Wang, et al., "A Ka-Band Cavity-Backed Patch Antenna with Parasitic Strips Using LTCC Multilayer Technology", In Proceedings of International Conference on Microwave and Millimeter Wave Technology, May 8, 2010, pp. 972-975.

* cited by examiner

CAVITY-BACKED SLOT ANTENNA

RELATED APPLICATIONS

This application claims priority to U.S. Provisional Patent Application No. 62/483,153, filed Apr. 7, 2017, which is incorporated herein by reference.

BACKGROUND

A display device, such as a tablet, monitor, or notebook computer, has a housing or a chassis to hold and protect the components of the device, such as its display. Device manufacturers are tending toward designing and building display devices with narrow bezels, which refers to the space from the edge of the viewable display to the outer edge of the housing.

DESCRIPTION

The following detailed description refers to the accompanying drawings. The same reference numbers in different drawings may identify the same or similar elements. Also, the following detailed description is for example and explanatory only and is not restrictive of the invention, as claimed.

Narrow bezels introduce difficult design criteria for some components of the display device, such as an antenna that may reside between the display and the housing. Implementations described below provide for an antenna that may reside between the display and the housing of a display device to allow for a narrow bezel.

Figure 1:
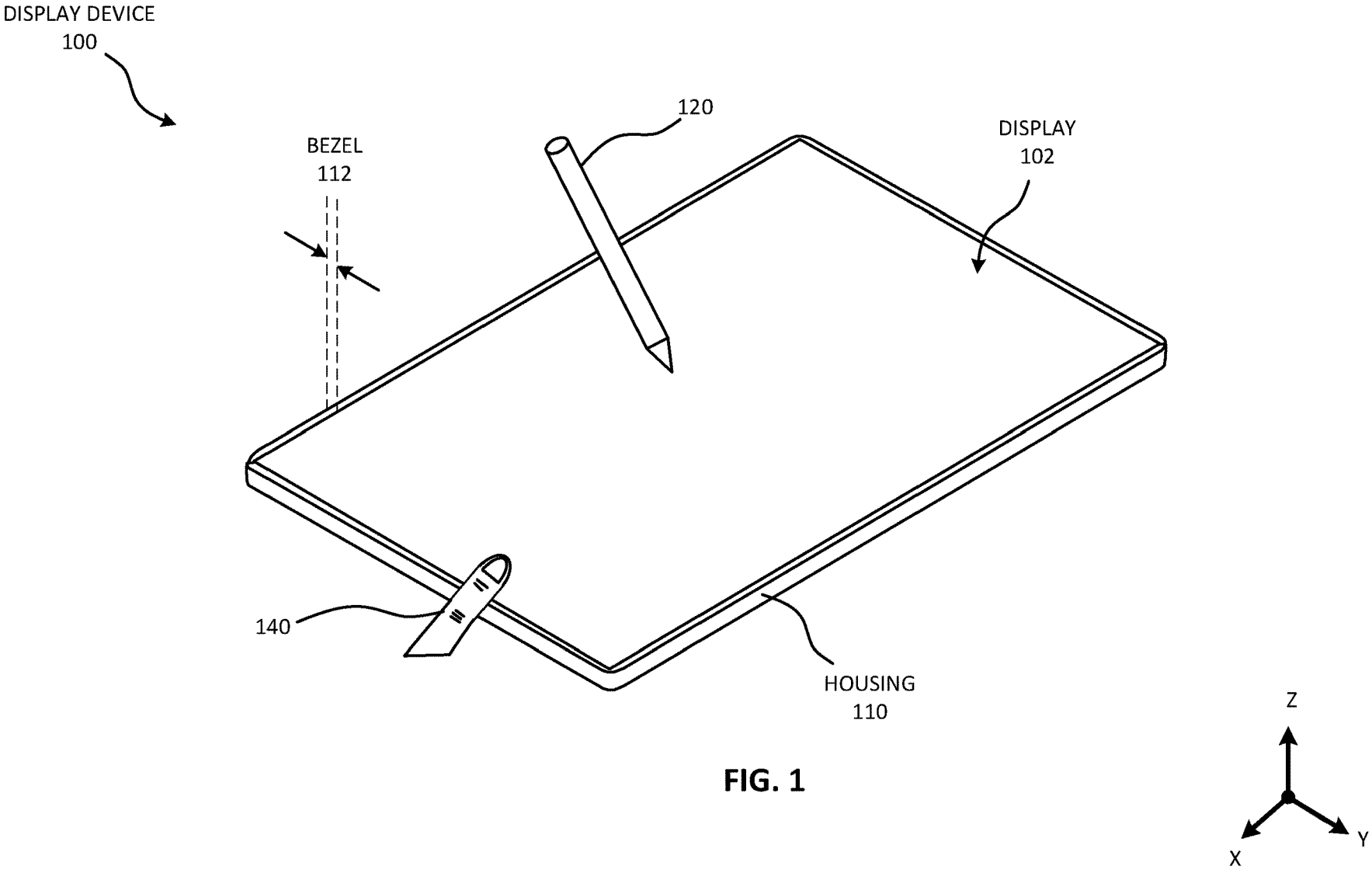
FIG. 1 is a perspective view of an example implementation of a display device manifest as a tablet computer.

FIG. 1 is a perspective view of an example implementation of display device 100, in one implementation, manifest as a tablet computer. Display device 100 includes a display 102 surrounded by a housing 110. Display 102 shows images and/or video for viewing by a user. Housing 110 encompasses and protects the components of display device 100, including display 102. A user may interact with display device 100 with fingertip 140 and/or stylus 120. The space between the outer edge of display 102 and housing 110 (either the inner or outer edge of housing 110) is often referred to as a bezel 112. Although display device 100 is shown as a tablet computer in FIG. 1, display device 100 may be a large display (such as a computer monitor or wall-mounted display), a mobile phone, a laptop, or any other device with a display for viewing.

Display device 100 includes one or more antennas (not shown) for communicating with other devices and/or sensing its environment. For example, the antenna may be for communicating with wireless base stations in a mobile communication network or a wireless local-area network. Alternatively, the antenna may be for sensing the presence or absence of a person or object in front of display device 100 (e.g., a proximity or presence sensor). Bezel 112 may include an array of antennas to image (i.e., radar imaging) a person or object in front of display device 100. The antenna may be located in many different places in display device 100 including the back of display device 100 and/or in bezel 112. Designs of display devices, particularly newer designs of tablets and mobile phones, tend to have narrow bezels. That is, when an antenna is in bezel 112, it may have strict dimensional requirements (i.e., narrow).

Antennas described herein may also be implemented in devices without a display. For example, a device may implement antennas described below when these antennas meet the design constraints of a device. FIG. 1 also defines an x-axis, y-axis, and z-axis such that the exposed layer of display 102 is the "top most" layer and the "bottom" of display device 100 is not visible in FIG. 1. These terms are relative and may be interchanged.

Figure 2:
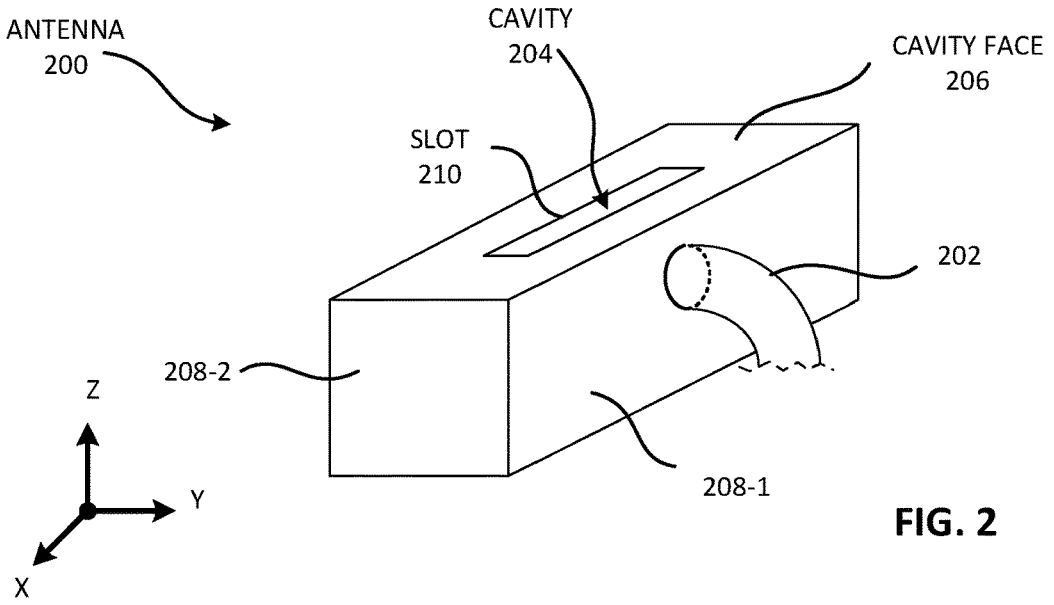
FIG. 2 is a perspective view of an example implementation of a cavity-backed slot antenna fed by a coaxial cable 202.

FIG. 2 is a perspective view of an example implementation of cavity-backed slot antenna 200 fed by a coaxial cable 202. Antenna 200 includes a cavity 204 surrounded by a top conductor 206 ("cavity face 206" or "top face 206") and five other sidewalls 208 (two of which are visible in FIG. 2 and referred to as sidewall 208-1 and sidewall 208-2). Sidewalls 208 may also be formed of conductive material and electrically coupled to cavity face 206. Cavity face 206 includes a slot 210 having an aperture. The fabrication and assembly of antenna 200 involves attaching a coaxial cable 202 to cavity 204 to feed energy to and/or receive energy from antenna 200. The end of coaxial cable 202 (not shown) may be attached to an RF connector (not shown) or other transmission line (not shown) for connecting to radio circuitry. The interior of cavity 204 of antenna 200 is shown in FIG. 3.

Figure 3:
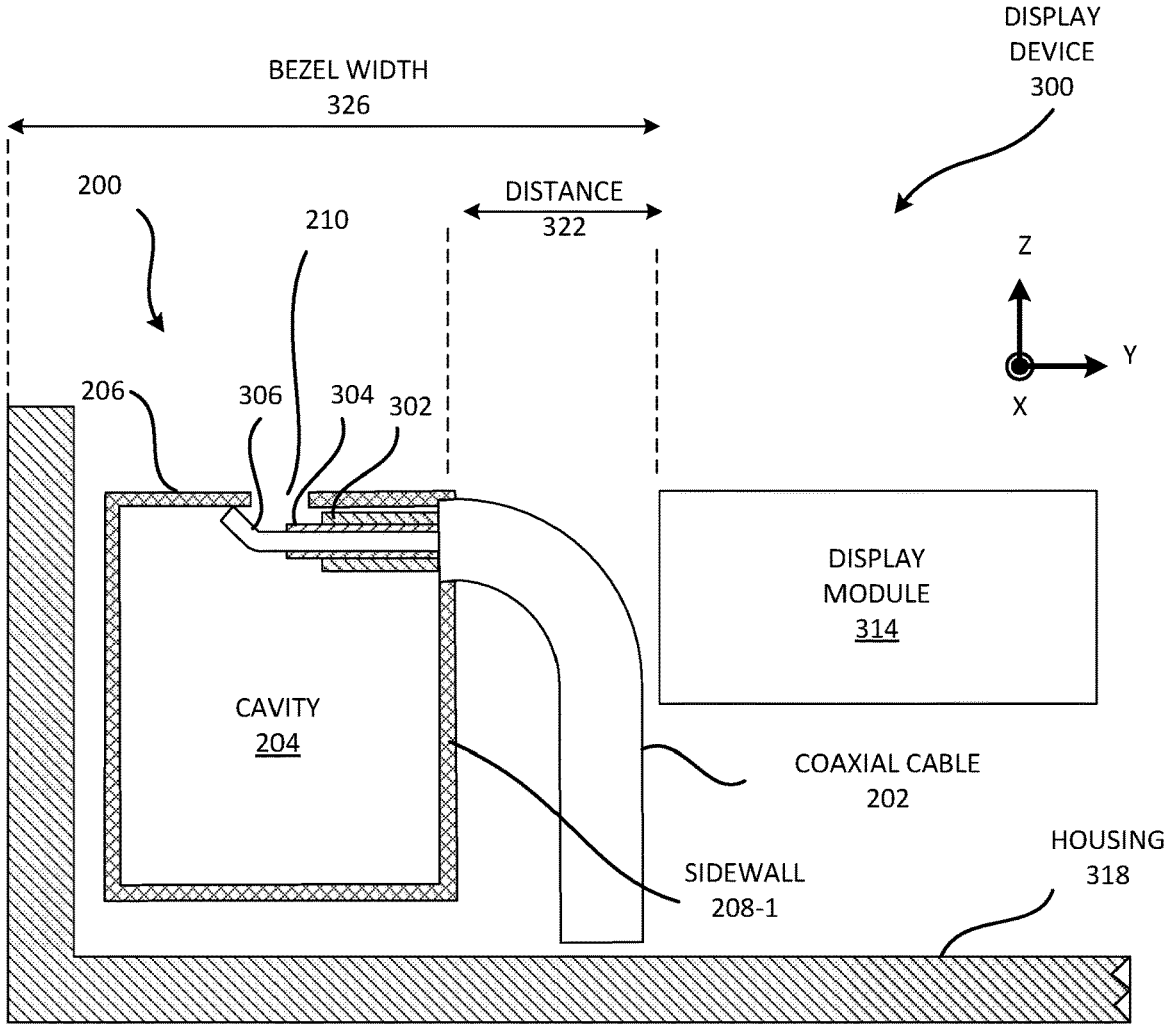
FIG. 3 illustrates a cross-sectional view of a display device including the cavity-backed slot antenna of FIG. 2.

FIG. 3 illustrates a cross-sectional view of a display device 300 including the cavity-backed slot antenna 200 of FIG. 2. As shown, in addition to antenna 200 fed by coaxial cable 202, display device 300 includes a display module 314 and a housing 318. Display device 300 may be a tablet computer, for example, like display device 100. Thus, display module 314 may correspond to display 102 and housing 318 to housing 110 of FIG. 1. Alternatively, display device 300 may be a large display (such as a computer monitor or wall-mounted display), a mobile phone, a laptop, an instrument panel, or any other device with a display for viewing. Display device 300 includes other components not shown for clarity, such as cover glass.

Coaxial cable 202 is shown entering the interior of cavity 204 in FIG. 3. Coaxial cable 202 includes an outer shielding 302, a dielectric insulator 304, and an inner conductor 306. Inner conductor 306 feeds energy to antenna 200 and may be soldered to the interior side of cavity face 206 within cavity 204. The energy fed to inner conductor 306 generates an electric field across slot 210 and electromagnetic waves propagate from antenna 200 away from display device 300. With the reverse process, antenna 200 may also receive electromagnetic waves.

Coaxial cable 202, as shown in FIG. 3, bends downward from sidewall 208-1 and is coupled to a driver circuit (not shown). In some instances, lumped components (not shown) may be placed (by solder, for example) near the interface between coaxial cable 202 and sidewall 208-1 of cavity 204 for impedance matching. The end of coaxial cable 202 opposite inner conductor 306 may be attached to an RF connector (not shown) or other transmission line (not shown) for connecting to radio circuitry.

Because the bend radius of coaxial cable 202 is limited, the distance 322 between sidewall 208-1 (to which cable 202 is connected) and display module 314 (and hence bezel width 326) may be larger than desired given particular design constraints, such as a narrow bezel of a display device. The bend radius of coaxial cable 202 may be limited, for example, because of the cable manufacturing process and materials or because of the risk of compromising the shielding effectiveness. Further, assembly of antenna 200 adjacent display module 214 may be difficult (e.g., connecting cable 202 to sidewall 208 and soldering in tight spaces) given a narrow-bezel design constraint, particularly with high-volume manufacturing. A narrow cavity 204, for example, may make soldering inner conductor 306 to cavity face 206 difficult. In addition, a small distance 322 between sidewall 208 and display module 314 may make bending coaxial cable 202 challenging. A narrow bezel may also make it difficult to solder lumped components (for impedance matching) to the interface between coaxial cable 202 and sidewall 208 of cavity 204.

As noted above, narrow bezels introduce difficult design criteria for some components of the display device, such as an antenna that may reside between the display and the housing. Implementation described below provide for an antenna that may reside between the display and the housing of a display device to allow for a narrow bezel. In some of these implementations, a stripline feed structure is integrated into the face and sidewall of a cavity-backed slot antenna. These implementations provide for impedance matching and antenna tuning by providing for: distributed matching components in the stripline; different shaped slots; different shaped feed structures; and floating resonators among other things.

Figure 4:
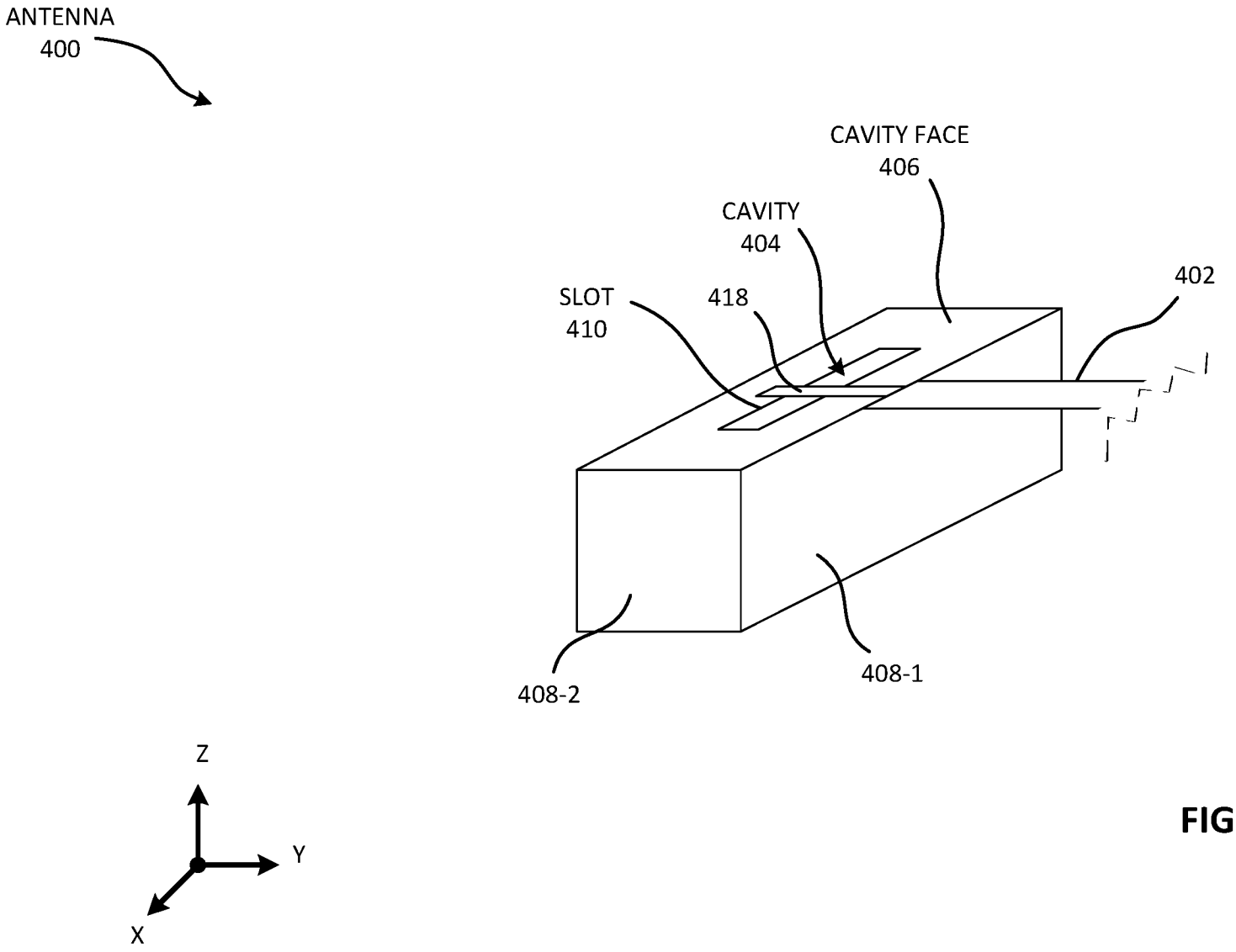
FIG. 4 is a perspective view of a cavity-backed slot antenna in one example implementation.

FIG. 4 is a perspective view of a cavity-backed slot antenna 400 in one implementation. Antenna 400 includes a stripline 402 to feed antenna 400. Like antenna 200, antenna 400 includes a cavity 404 surrounded by six sidewalls: a top conductor 406 (referred to as "cavity face 406" or "top face 406") and five other sidewalls 408 (two of which are visible in FIG. 4 and referred to sidewall 408-1 and sidewall 408-2). Sidewalls 408 may also be formed of conductive material (such as aluminum) and electrically coupled to cavity face 406. Cavity face 406 includes and defines the geometry of a slot 410 with a rectangular aperture in this example. Other geometries of slot 410 are possible as discussed below. As compared to antenna 200 of FIG. 2, antenna 400 does not include a coaxial cable (i.e., coaxial cable 202). Instead, energy is delivered to antenna 400 through stripline 402. A central conductor emerges from stripline 402 (i.e., feed 418) to excite an electric field across slot 410, from which electromagnetic waves propagate. The end of stripline 402 opposite feed 418 may be attached to an RF connector (not shown) or other transmission line (not shown) for connecting to radio circuitry.

Figure 5:
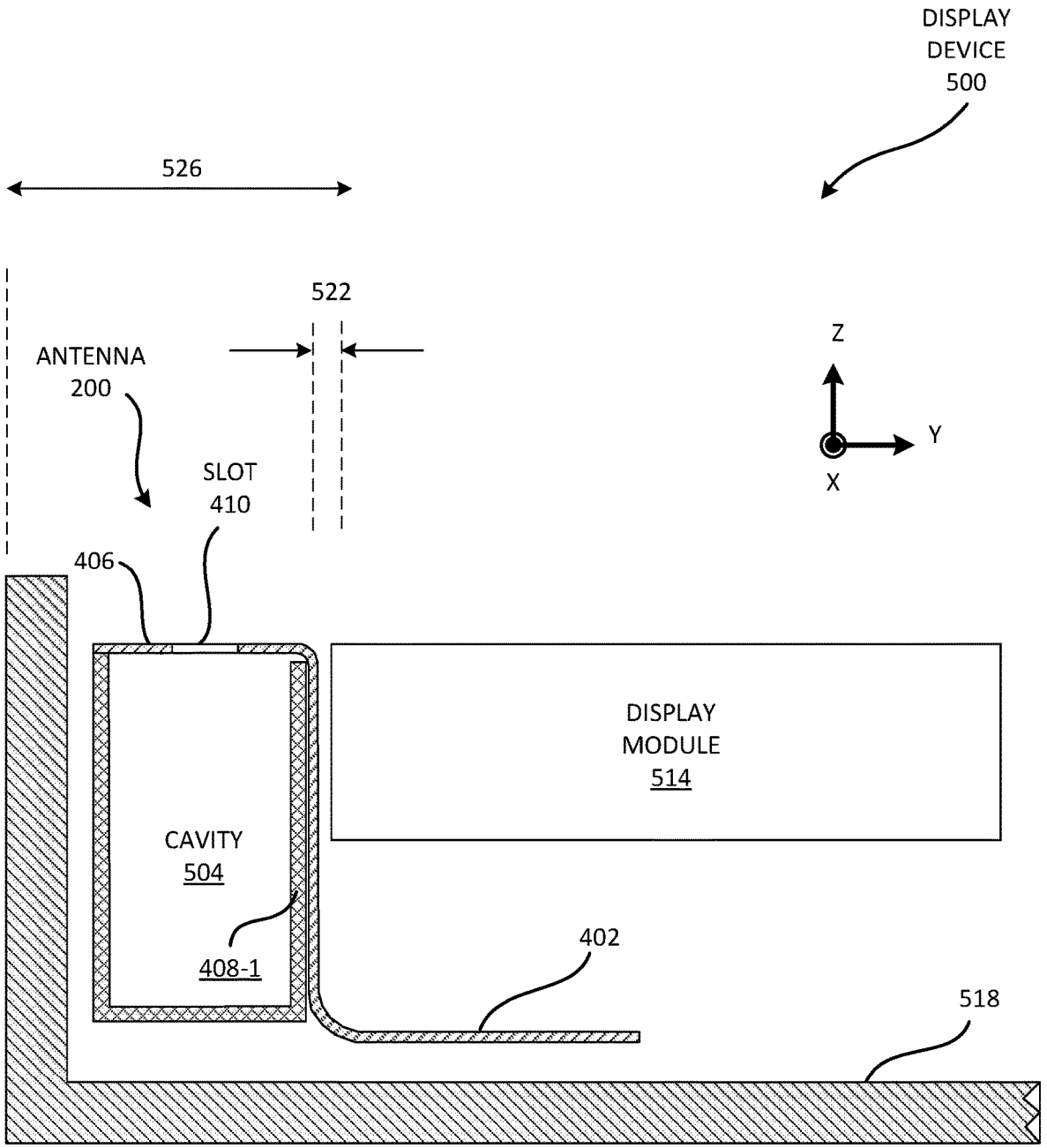
FIG. 5 is a cross-sectional view of a display device including the cavity-backed slot antenna of FIG. 4.

The different implementations of antenna 400 are discussed below. In contrast to coaxial cable 202 described above in relation to FIG. 2, stripline 402 may be more flexible than a coaxial cable. FIG. 5 is a cross-sectional view of a display device 500 including cavity-backed slot antenna 400 (also shown in FIG. 4) alongside a display module 514 within a housing 518. Because of the greater flexibility of stripline 402 (compared to coaxial cable 202), the bend radius of stripline 402 can be smaller than that of coaxial cable 202. Therefore, as shown in FIG. 5 (compared to FIG. 4), the distance 522 between antenna 400 and display module 514 can be less than the corresponding distance in display device 300 (i.e., the distance 322 between display module 314 and antenna 200). As such, the implementation shown in FIG. 5 may allow for a narrower bezel (i.e., bezel width 526).

Figure 6A:
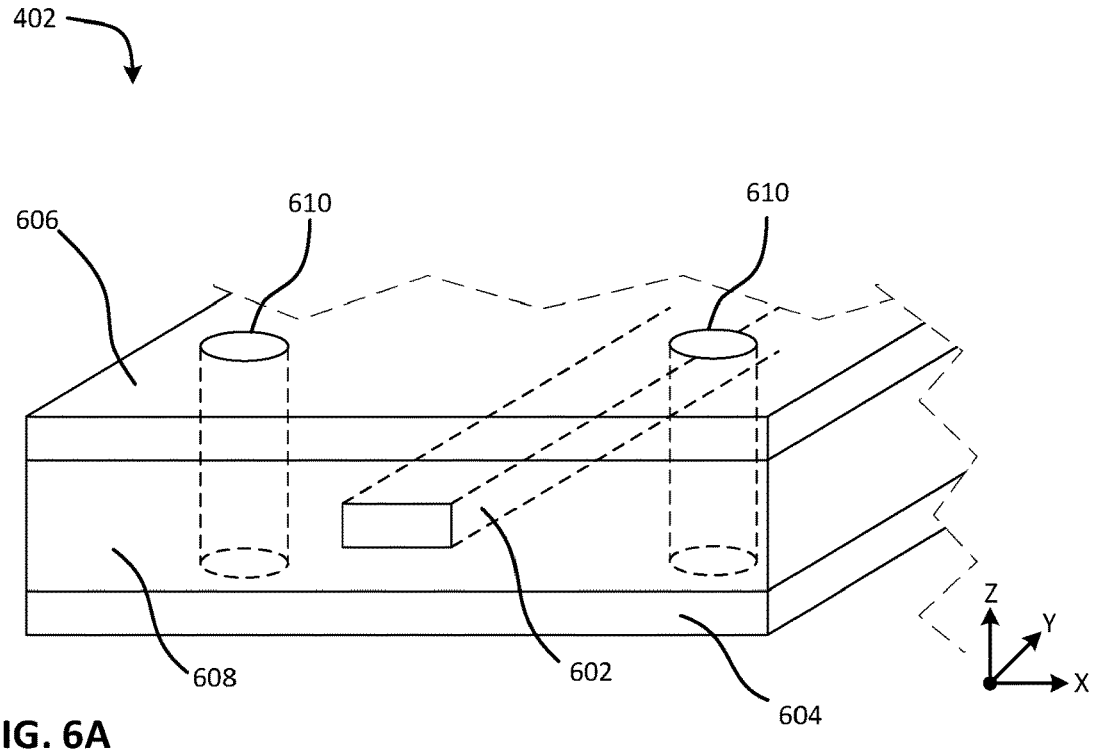
FIGS. 6A and 6B illustrate the example implementation of the stripline of FIG. 4.

Stripline 402 acts as a low-loss transmission line from antenna circuitry (not shown) to antenna 400. Stripline 402 may also provide a known impedance (e.g., 50 or 75 Ohms) to deliver energy to or receive energy from antenna 400. FIG. 6A illustrates the example implementation of stripline 402 of FIG. 4. Stripline 402 includes a central conductor 602 sandwiched between two ground planes: a bottom ground plane 604 and a top ground plane 606. Central conductor 602 may also be referred to as a "conductive strip." "Top" and "bottom" are relative terms and can be interchanged. The ground planes 604, 606 are separated from central conductor 602 by an insulator 608, such as a dielectric layer. Vias 610 electrically connect or tie the two ground planes 606, 604 to ensure ground planes 604, 606 maintain the same potential given the frequency. Vias 610 occur along the length of stripline 402. The higher the frequency that central conductor 602 is expected to carry, the closer together vias 610. Thus, stripline 402 includes three conductive layers: central conductor 602 and two ground planes 604 and 606. The shape of stripline 402 may be generally planar given the shape of its components (i.e., ground plane 606 and ground plane 604). Stripline 402 may also be referred to as a "flexible printed circuit," a "flexible printed transmission line," or a "flexible planar transmission line."

Figure 6B:
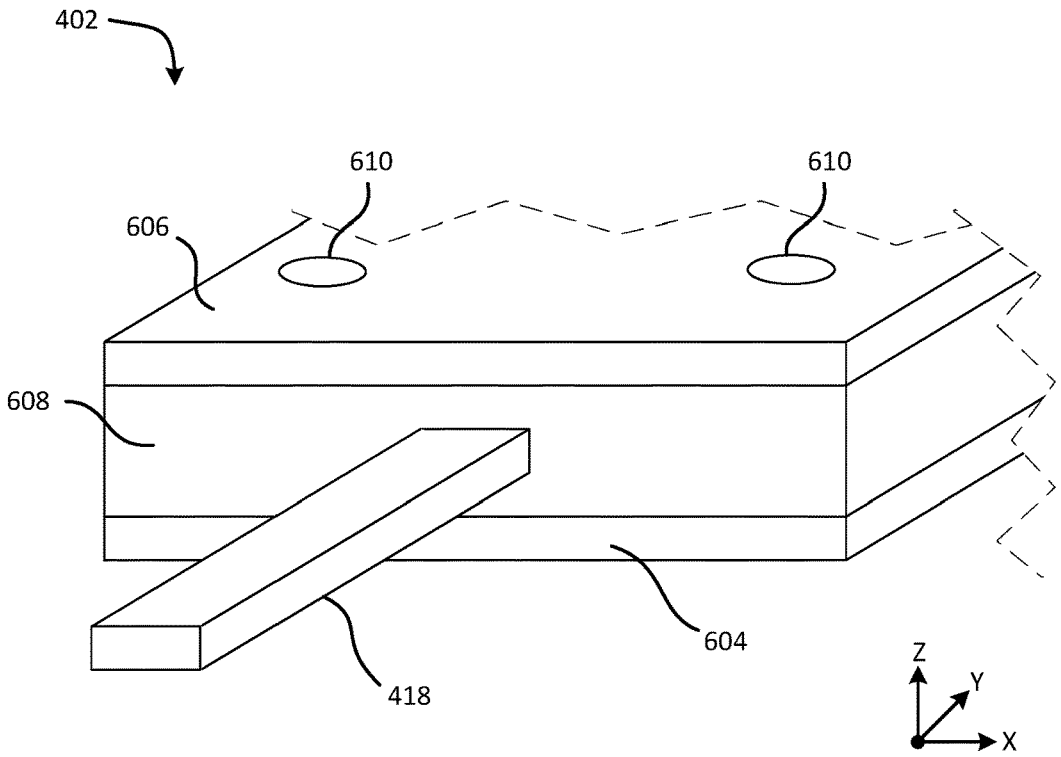
Figure 7:
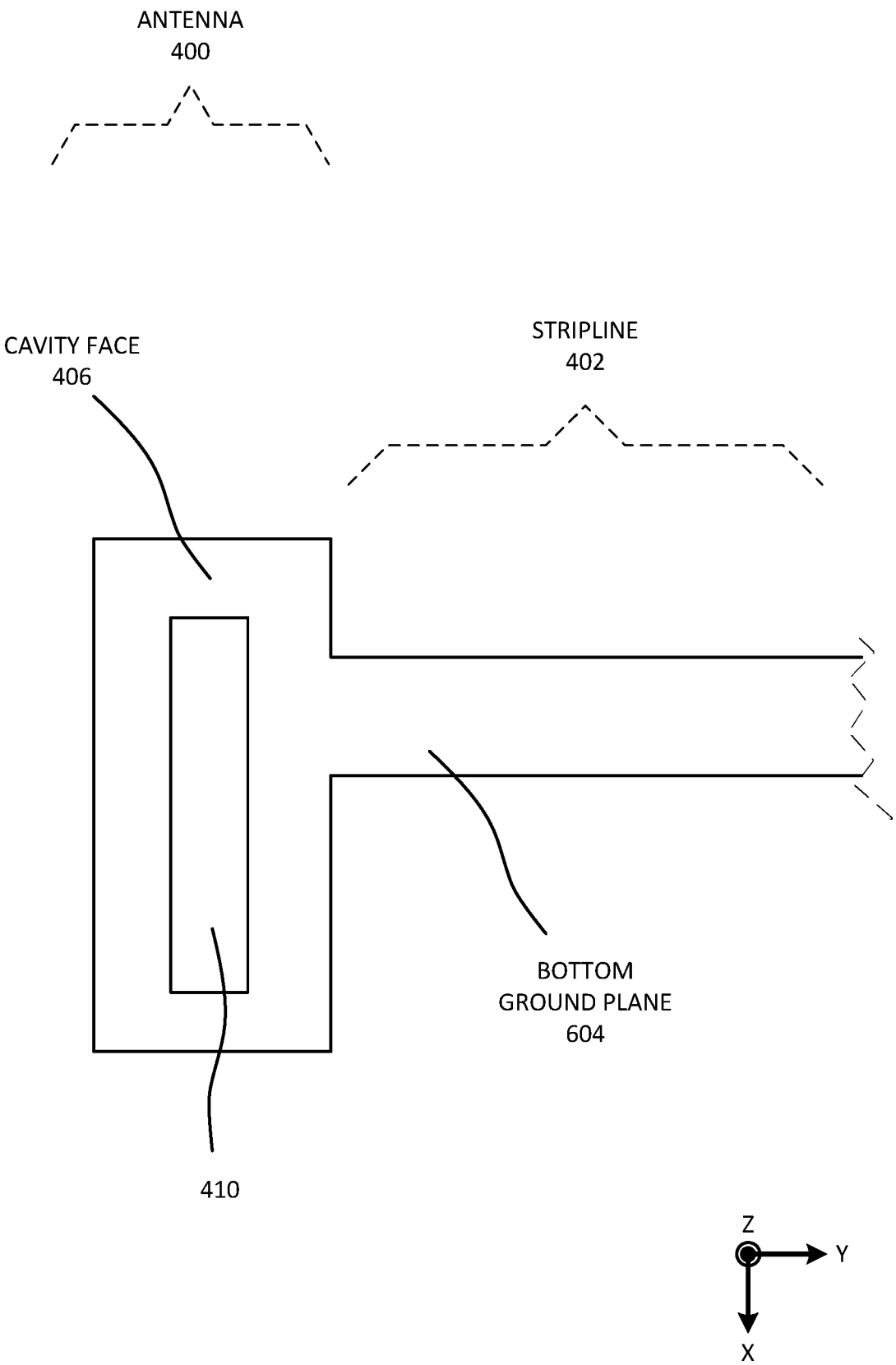
FIG. 7 illustrates an example implementation of a ground plane of the stripline of the antenna of FIG. 4.

FIG. 6B shows an implementation in which central conductor 602 of stripline 402 (as shown in FIG. 6A) extends past insulator 608 as a feed (such as feed 418 shown in FIG. 4). In one implementation (not shown in FIG. 6B), bottom ground plane 604 may also extend in the same direction as feed 418 to form cavity face 406 of antenna 400. In other words, bottom ground plane 604 of stripline 402 can be extended to include and define the size and geometry of slot opening 410 of cavity face 406. In other words, the cavity face 406 may be integrated with stripline 402. In addition, stripline and cavity face 406 may be part of the same flexible circuit or flexible printed circuit. For example, FIG. 7 illustrates an example implementation of ground plane 604 of stripline 402 that extends to form cavity face 406 of antenna 400. For ease of understanding, FIG. 7 only shows bottom ground plane 604 and cavity face 406 without showing other layers of stripline 402 or antenna 400. Bottom ground plane 604 of stripline 402 may be continuous with cavity face 406 of antenna 400 and, for example, formed of a continuous piece of conductive material such as copper. Slot 410 is rectangular in the example of FIG. 7, but other geometries of slot 410 are possible, as discussed and shown herein. In this example, cavity face 406 is continuous and surrounds slot 410. Cavity face 406 may be soldered to sidewalls 408 (i.e., sidewalls 408-1 and 408-2) to form cavity 404 with slot 410. In another implementation, cavity face 406 may be adhered to sidewalls 408 with a conductive adhesive to form cavity 404 with slot 410. In either case, cavity face 406 is connected to (including electrically connected to) sidewalls 408.

Figure 8:
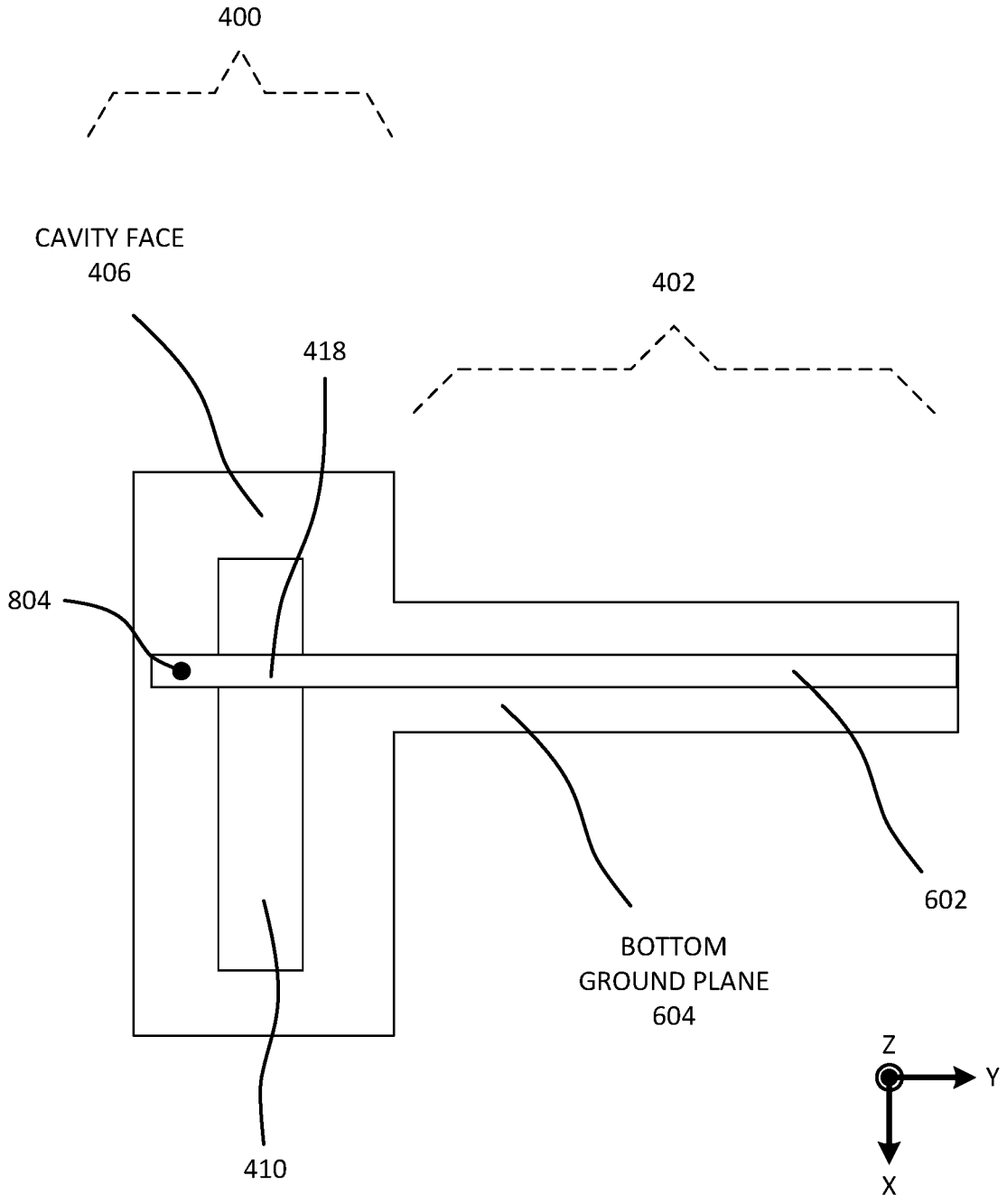
FIG. 8 illustrates the example implementation of the cavity face and feed of the antenna of FIG. 4 and the central conductor of the stripline of FIG. 4.

As noted, FIG. 7 shows only one conductive layer of stripline 402 and antenna 400. FIG. 8 illustrates two layers: first, ground plane 604 and cavity face 406; and second, central conductor 602 and feed 418. For ease of understanding, FIG. 8 omits some features of stripline 402 and antenna 400. For example, FIG. 8 does not show an insulating layer (i.e., insulator 608) or top ground plane 606 of stripline 402.

As shown in FIG. 8, central conductor 602 emerges from stripline 402 to form feed 418 of antenna 400. Central conductor 602 of stripline 402 may be continuous with feed 418 of antenna 400 and, for example, formed of a continuous conductive material, such as copper. In one implementation, feed 418 is connected to cavity face 406 by via 804 on the side of slot 410 opposite the side where feed 418 emerges from stripline 402. In other words, via 804 short circuits feed 418 to the conductive top of cavity face 406. More than one via 804 may be used to tie feed 418 to cavity face 406. In this implementation, via 804 may eliminate a solder connection between a feed (such as inner conductor 306) and the body of a cavity (such as cavity face 206 of antenna 200). In one implementation, feed 418 includes a rectangular configuration over slot 410, as shown in the example of FIG. 8, but other geometries of feed 418 are possible, as discussed herein.

Figure 9A:
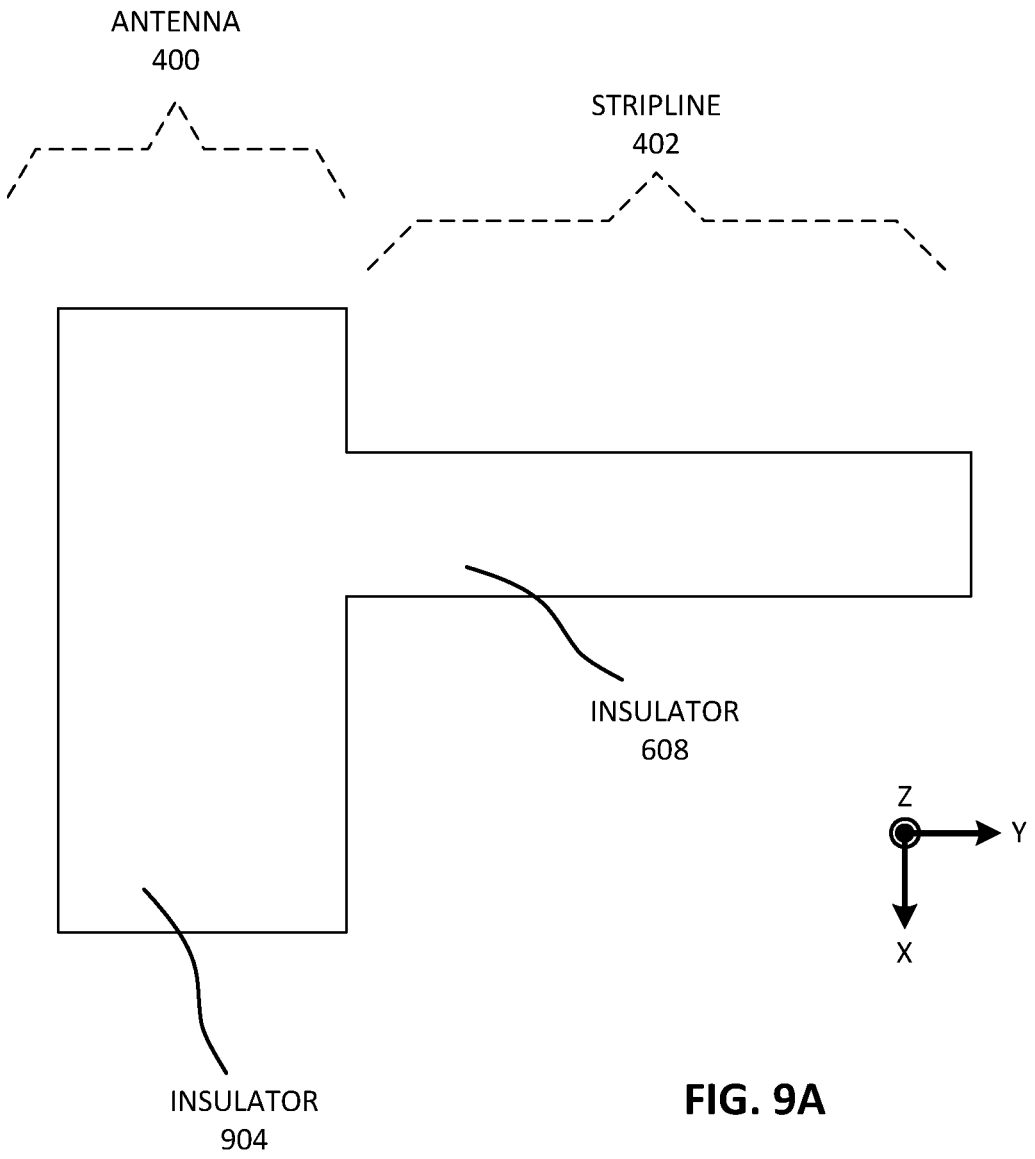
FIGS. 9A, 9B, and 9C illustrate the example implementation of insulators of a stripline and the antenna of FIG. 4.

As noted above, FIGS. 7 and 8 omit features of stripline 402 and antenna 400. For example, FIGS. 7 and 8 omit insulator 608 of stripline 402. In addition, FIGS. 7 and 8 omit insulation that isolates feed 418 from cavity face 406 in antenna 400. FIG. 9A illustrates a top view of example implementation of insulators of stripline 402 and antenna 400. For ease of understanding, FIG. 9A omits other features of stripline 402 and antenna 400 (such as the conductive layers). As shown, stripline 402 includes insulator 608 and antenna 400 includes insulator 904. Insulator 608 insulates central conductor 602 from ground planes 604, 606 (see FIG. 6A). Insulator 904 insulates feed 418 from cavity face 406 (see FIG. 8). In one implementation, via 804 passes through insulator 904 to short feed 418 to cavity face 406. Like insulator 608, insulator 908 may be formed of a dielectric material. Insulator 904 of antenna 400 may be continuous with insulator 608 of stripline 402 and, for example, formed of a continuous piece of dielectric. Insulator 904 may cover and be coextensive with the conductive top of cavity face 406 (see FIGS. 7 and 8).

Figure 9B:
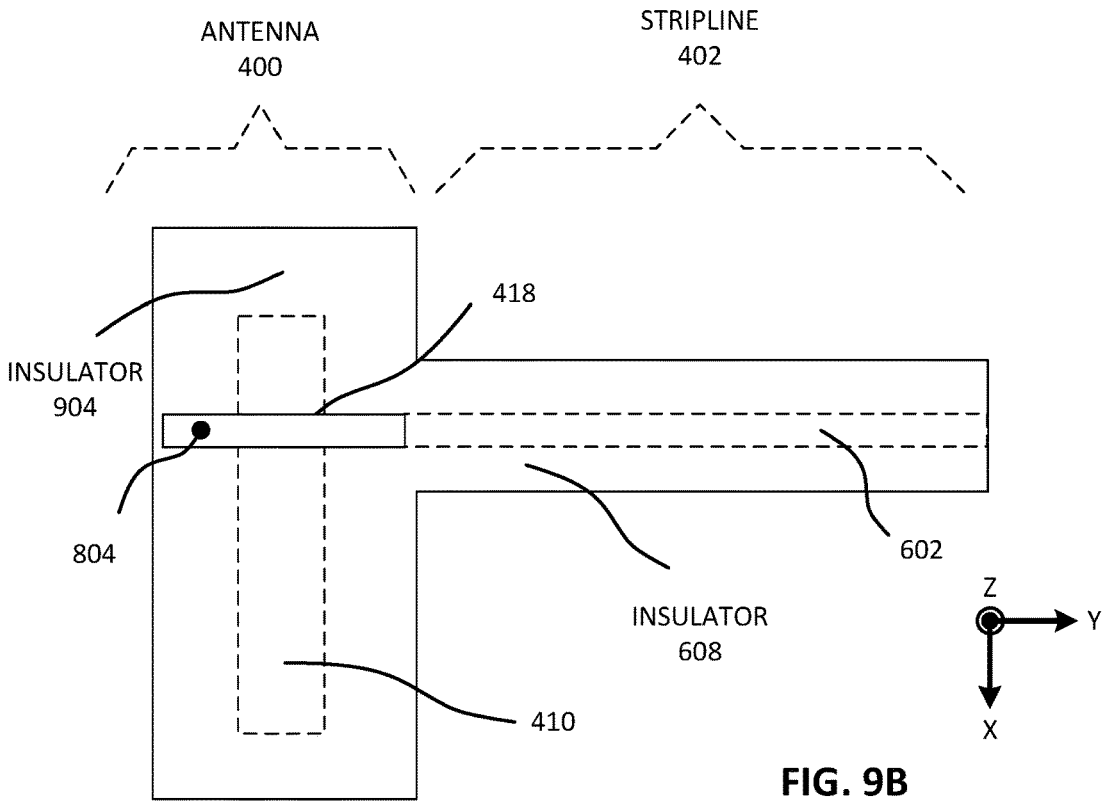
Figure 9C:
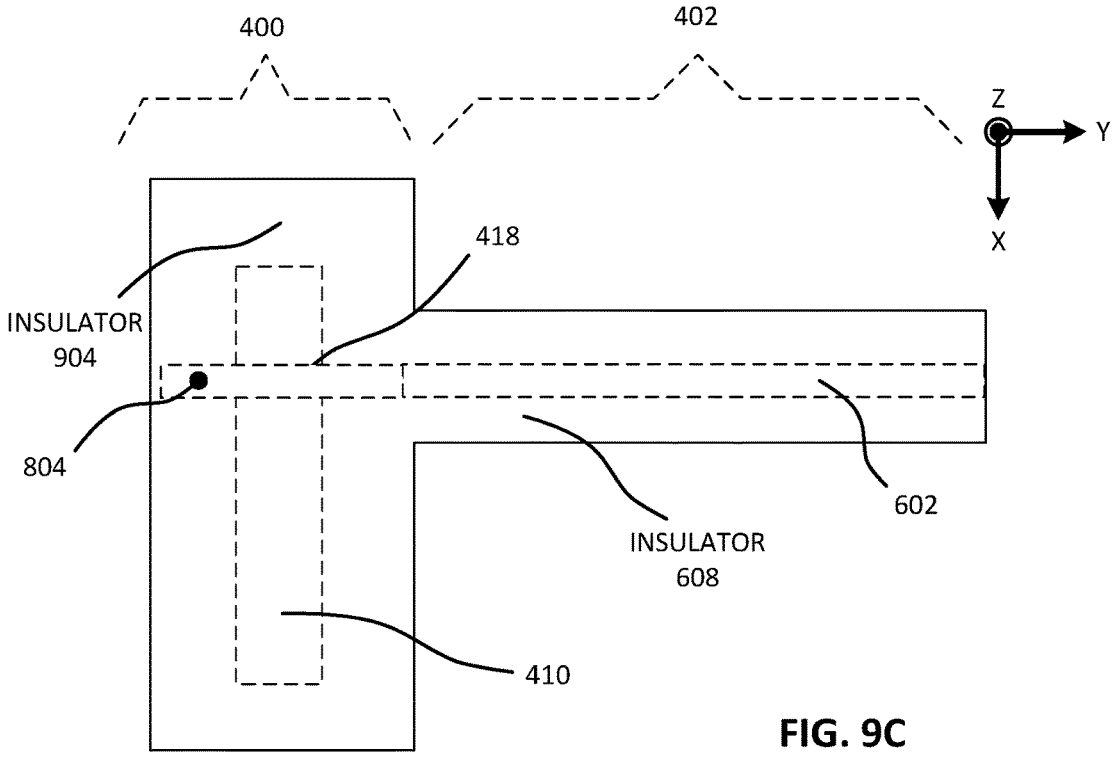

For additional understanding, FIGS. 9B and 9C add feed 418, central conductor 602, and slot 410 to the illustration of insulators 904, 608 of FIG. 9A. FIGS. 9B and 9C omit, however, some features of stripline 402 and antenna 400. For example, FIGS. 9B and 9C do not show top ground plane 606 or vias 610 of stripline 402. As shown in FIG. 9B and discussed above, insulator 608 extends in the same direction as feed 418 (from stripline 402) to form insulator 904 to insulate feed 418 from cavity face 406. In the implementation of FIG. 9B, insulator 608 in stripline 402 surrounds (is above, to the sides, and beneath) central conductor 602, which is delineated with a dashed line. On the other hand, insulator 904 in antenna 400 separates cavity face 406 from feed 418, but feed 418 (shown with a solid line) is not necessarily covered by insulator 904 in its entire length. As noted above, insulator 904 covers and is coextensive with the outer reaches of cavity face 406, the slot 410 being shown with a dashed line.

In another implementation, as shown in FIG. 9C, insulator 904 may also cover feed 418 (i.e., is above, beneath, and to the sides) to the same or lesser extent (i.e., thickness) that insulator 608 covers central conductor 602. As a result, feed 418 is shown with a dash line in FIG. 9C to illustrate that insulator 904 covers feed 418. In this implementation as well, insulator 904 is coextensive with the outer reaches of cavity face 406. Covering feed 418 with insulator 904 may provide mechanical features, such as stiffening for assembly and/or simplifying the attachment of cavity face 406 to sidewalls 408. In addition to providing these mechanical features, insulator 904 may provide dielectric loading for antenna 400, for example. The cover glass (not shown) that provides protection to display module 514 to device 500, may also provide dielectric loading to antenna 400 if the cover glass covers antenna 400. In one implementation, insulator 904 may be uniformly thick over cavity face 406.

Figure 10A:
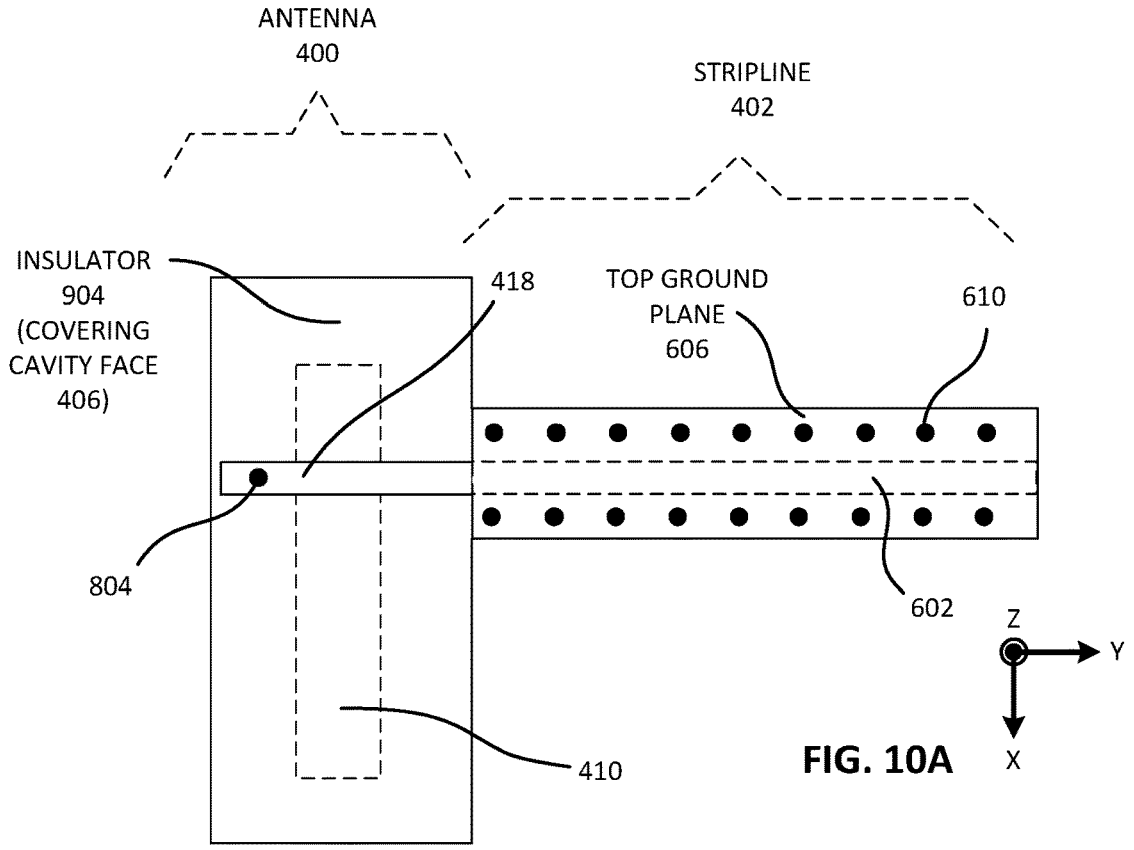
FIGS. 10A and 10B illustrate two example implementations of feed structures for the antenna of FIG. 4.
Figure 10B:
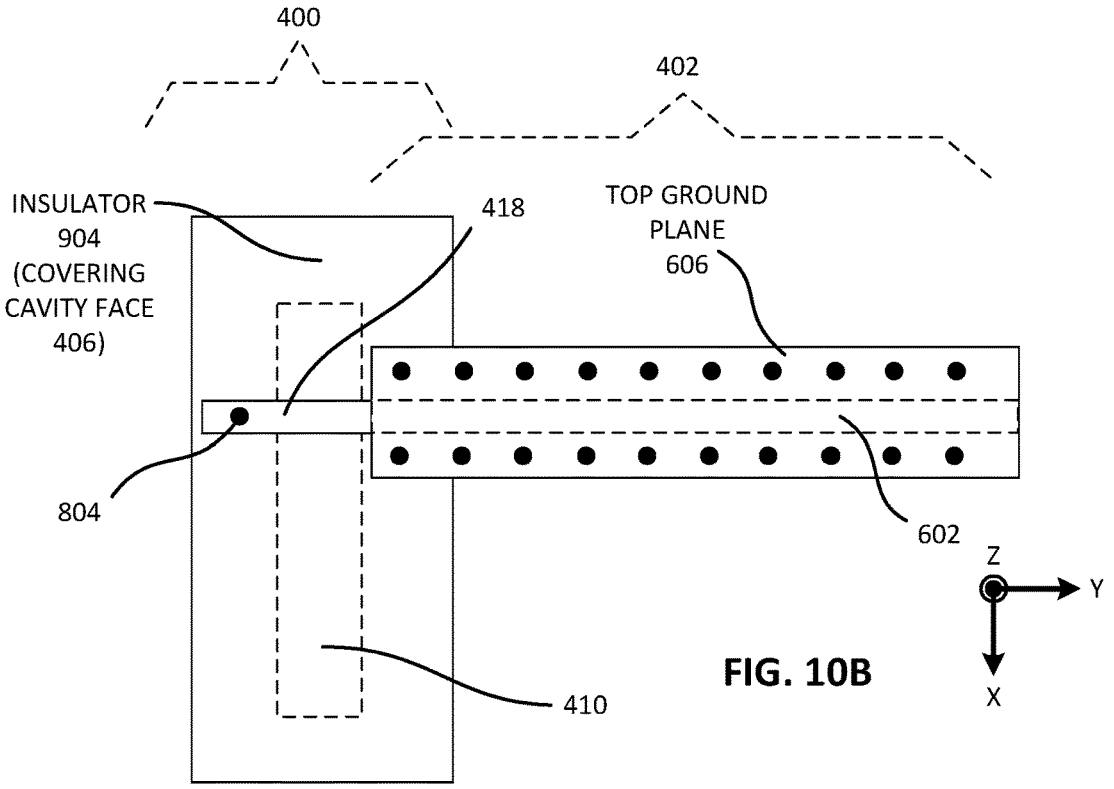

As noted above, top ground plane 606 covers stripline 402 and is separated from central conductor 602 by insulator 608. FIGS. 10A and 10B illustrate a top view of top ground plane 606, central conductor 602, feed 418, and insulator 904 of antenna 400 in one implementation. As shown in FIGS. 10A and 10B, top to ground plane 606 is rectangular and includes vias 610 (see FIG. 6A) that electrically tie top ground plane 606 with bottom ground plane 604. In FIG. 10A, top ground plane 606 extends to sidewall 408-1 of antenna 400 but does not cover cavity face 406 of antenna 400. Thus, stripline 402 in FIG. 10A reaches sidewall 408-1 of antenna 400 but does not extend above cavity face 406. The implementation of FIG. 10A may be referred to as a "partial microstrip launch" because feed 418 is not covered by top ground plane 606. That is, the transmission structure over cavity face 406 resembles the structure of a microstrip. With this partial microstrip launch, the width of the central conductor (i.e., across the cavity wall or above cavity face 406) may be varied to provide a tuning and/or matching element. In FIG. 10B, in contrast, top ground plane 606 extends over cavity face 406 of antenna 400 and reaches the edge of slot 410. Therefore, in one implementation, the feed emerges from the stripline proximate an edge of the slot of the antenna. In another implementation, the feed emerges from the stripline proximate an edge of the antenna where the stripline meets the antenna.

Figure 11A:
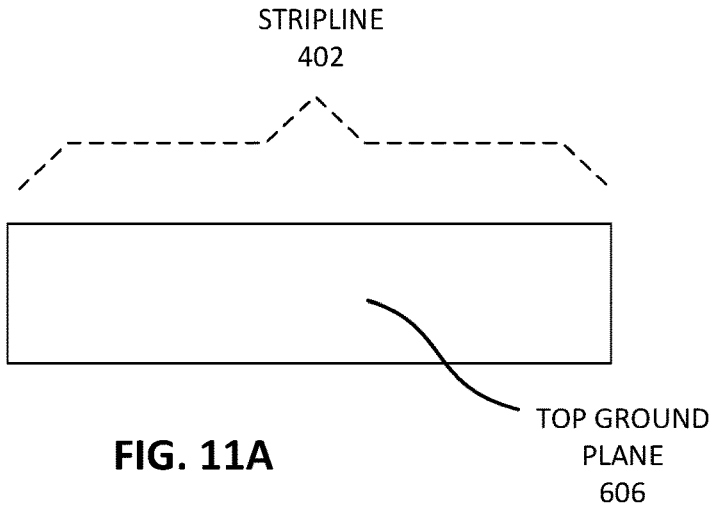
FIGS. 11A, 11B, 11C, 11D, and 11E illustrate an example implementations of a top ground plane and a floating conductive plane of the antenna and feed structure of FIG. 4.
Figure 11B:
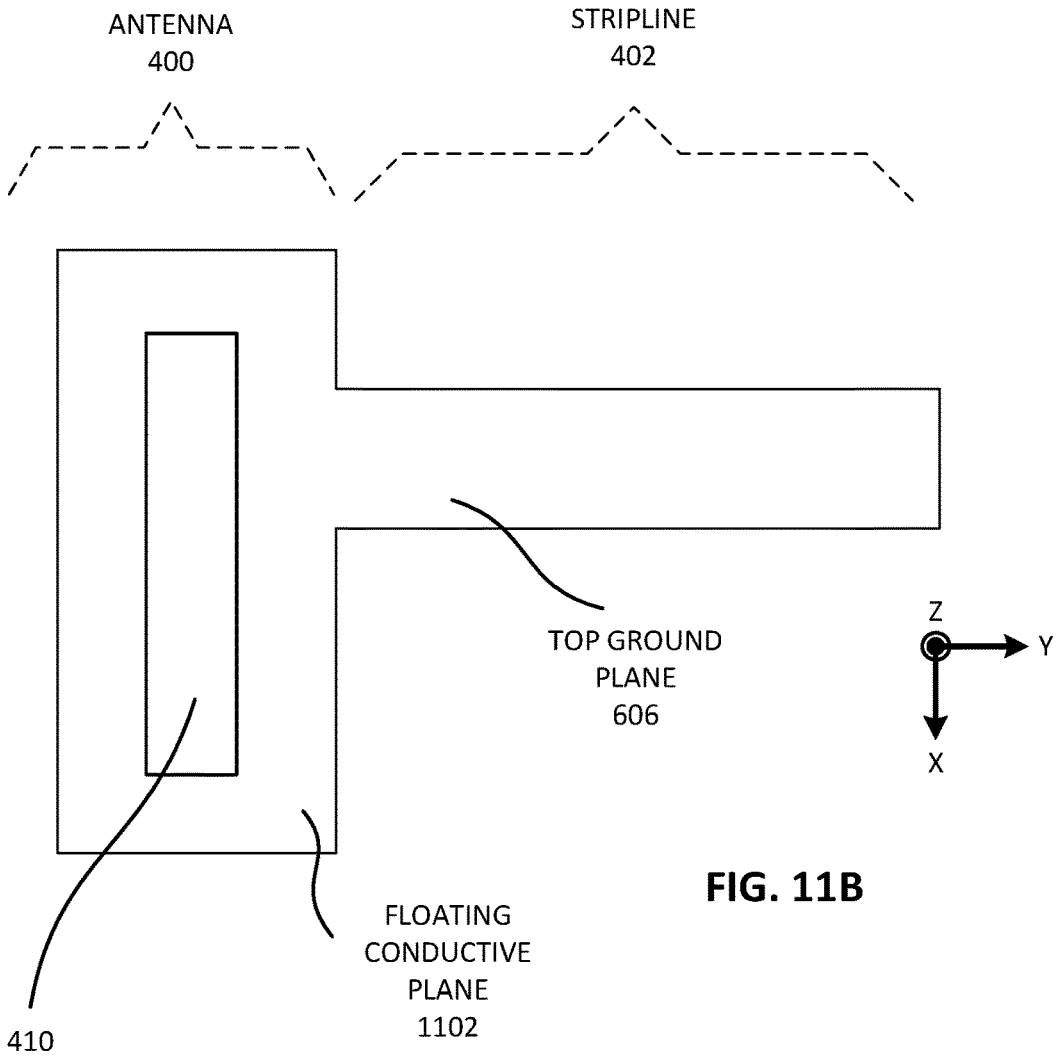

FIG. 11A illustrates a top view of top ground plane 606 (i.e., rectangular) of stripline 402 as described with respect to FIGS. 10A and 10B. In one implementation, top ground plane 606 may extend around the perimeter of slot 410 of antenna 400, as shown in FIG. 11B, to form a floating conductive plane 1102. For clarity, FIGS. 11A and 11B only shows top ground plane 606 and/or floating conductive plane 1102 and no other features of stripline 402 or antenna 400. Like cavity face 406, floating conductive plane 1102 may include the geometry of slot 410. Floating conductive plane 1102 "floats" because it is separated from the conductive cavity face 406 of antenna 400 by an insulator. Floating conductive plane 1102 may be referred to as a "floating perimeter loop." Floating conductive plane 1102 in the implementation of FIG. 11B is above and coextensive with cavity face 406.

In one implementation, another insulation layer (such as a dielectric, but not shown in FIG. 11B) may be laid on top of floating conductive plane 1102 that extends over antenna 400. This insulator may provide dielectric loading for antenna 400, for example. The cover glass (not shown) that provides protection to display module 514 to device 500, for example, may also provide dielectric loading to antenna 400.

Figure 11C:
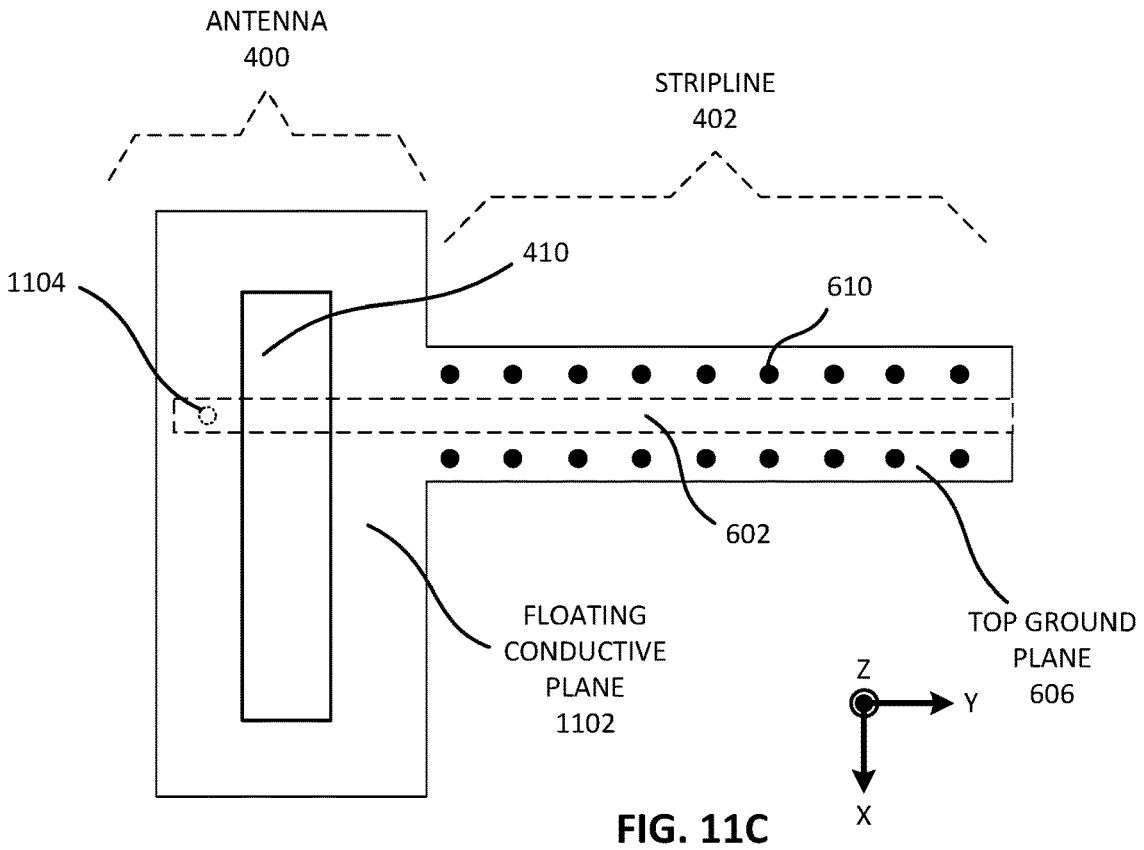
Figure 11D:
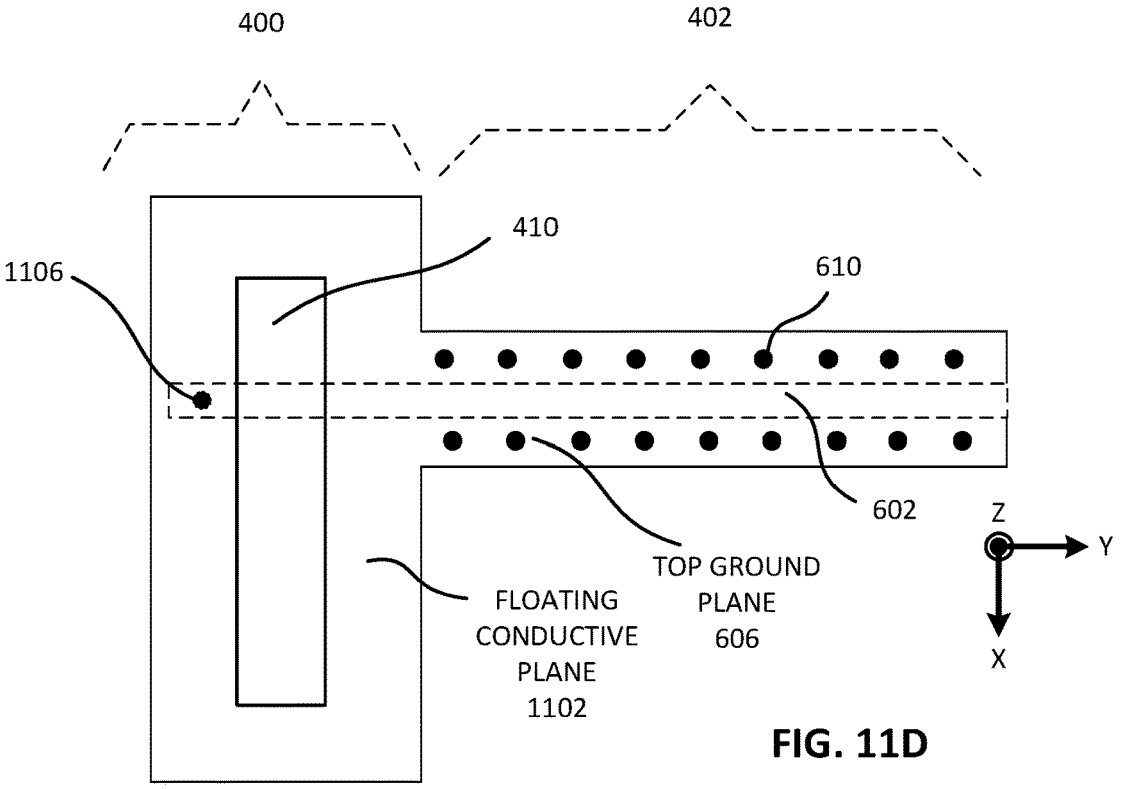

FIGS. 11C and 11D show a top view of top ground plane 606 of stripline 402 and floating conductive plane 1102 (as shown in FIG. 11B), including central conductor 602 and feed 418. In FIG. 11C, feed 418 is tied to cavity face 406 (see FIG. 4) by a blind via 1104. In other words, blind via 1104 connects feed 418 to cavity face 406 but does not connect feed 418 to floating conductive plane 1102. In FIG. 11C, feed 418 is tied to cavity face 406 and floating conductive plane 1102 by via 1106. In this regard, floating conductive plane 1102 of FIG. 11C is less "floating" than that of FIG. 11D. In both these implementations, more than one via and/or blind via may be used to tie different conductive layers.

Figure 11E:
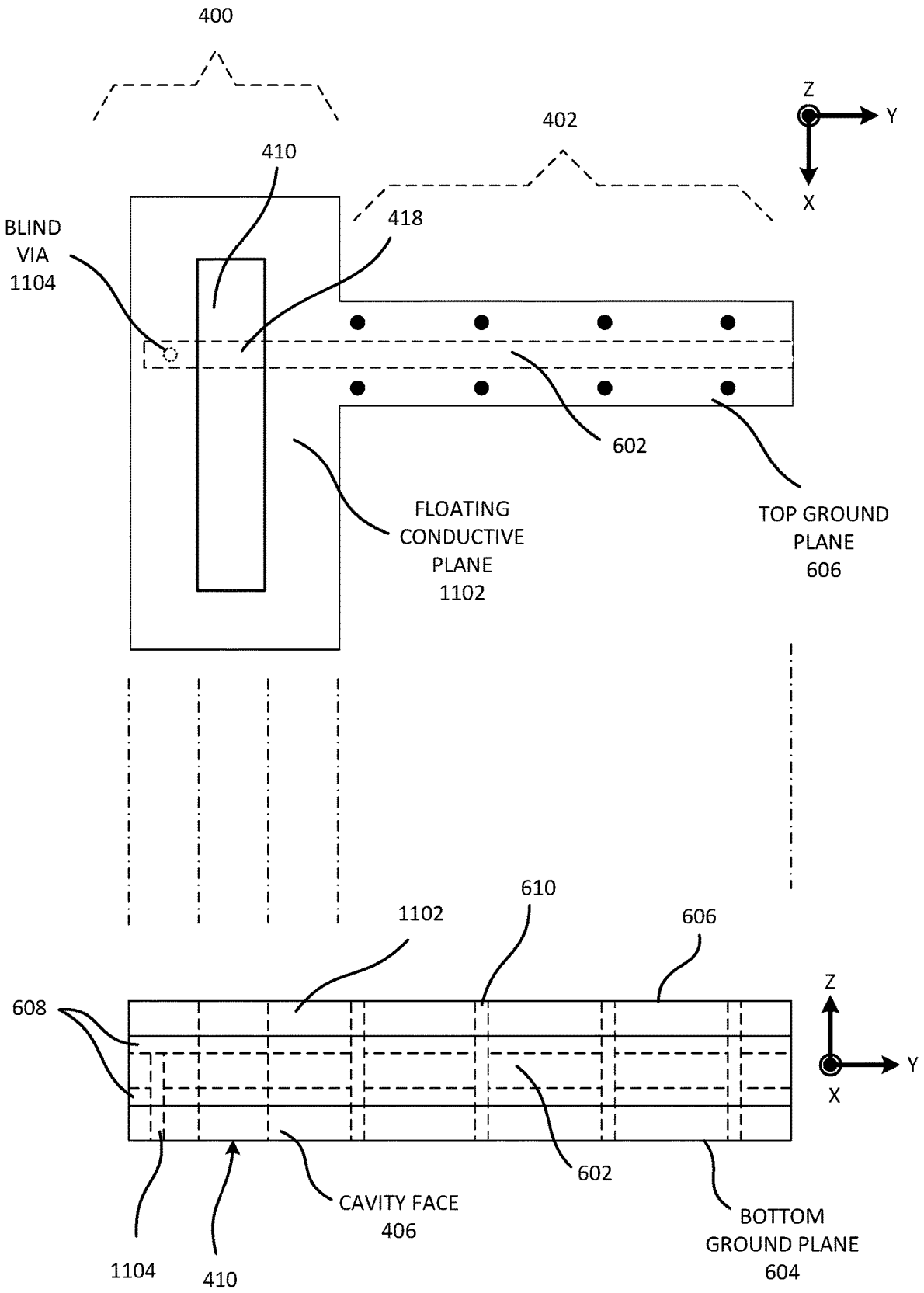

FIG. 11E combines the features discussed above in FIGS. 7, 8, 9A, 9C, 11B, and 11C. That is, FIG. 11E shows a top and side view of stripline 402 (with vias 610) and antenna 400 (with floating conductive plane 1102 surrounding slot 410). The top of FIG. 11E shows the top view of antenna 400 and stripline 402, while the bottom of FIG. 11E shows the side view of antenna 400 and stripline 402. The top and side view of antenna 400 and stripline 402 both show top ground plane 606, central conductor 602, vias 610, feed 418, slot 410, and blind via 1104. In addition, the side view shows insulator 608 between floating conductive plane 1102 and feed 418; between bottom ground plane 604 and central conductor 602; and between cavity face 406 and feed 418. The side view of FIG. 11E shows three conductive layers: a top layer that includes floating conductive plane 1102 and top ground plane 606; a middle layer that includes feed 418 and central conductor 602; a bottom layer that includes bottom ground plane 606 and cavity face 406. Vias 610 tie the top layer and the bottom layer in stripline 402. Blind via 1104 ties feed 418 and cavity face 406 of antenna 400. In another implementation, one or more vias may tie floating conductive plane 1102 to cavity face 406 of antenna 400.

Figure 12A:
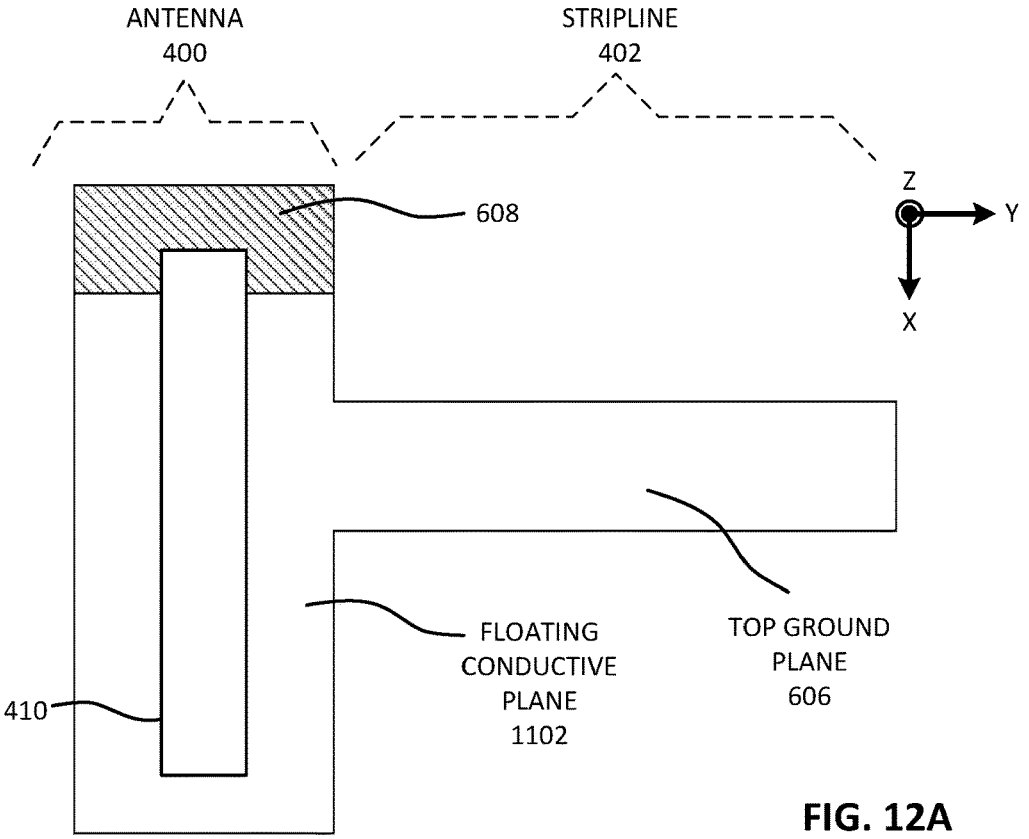
FIGS. 12A and 12B illustrate example implementations of a top ground plane and a floating conductive plane of the antenna and feed structure of FIG. 4.
Figure 12B:
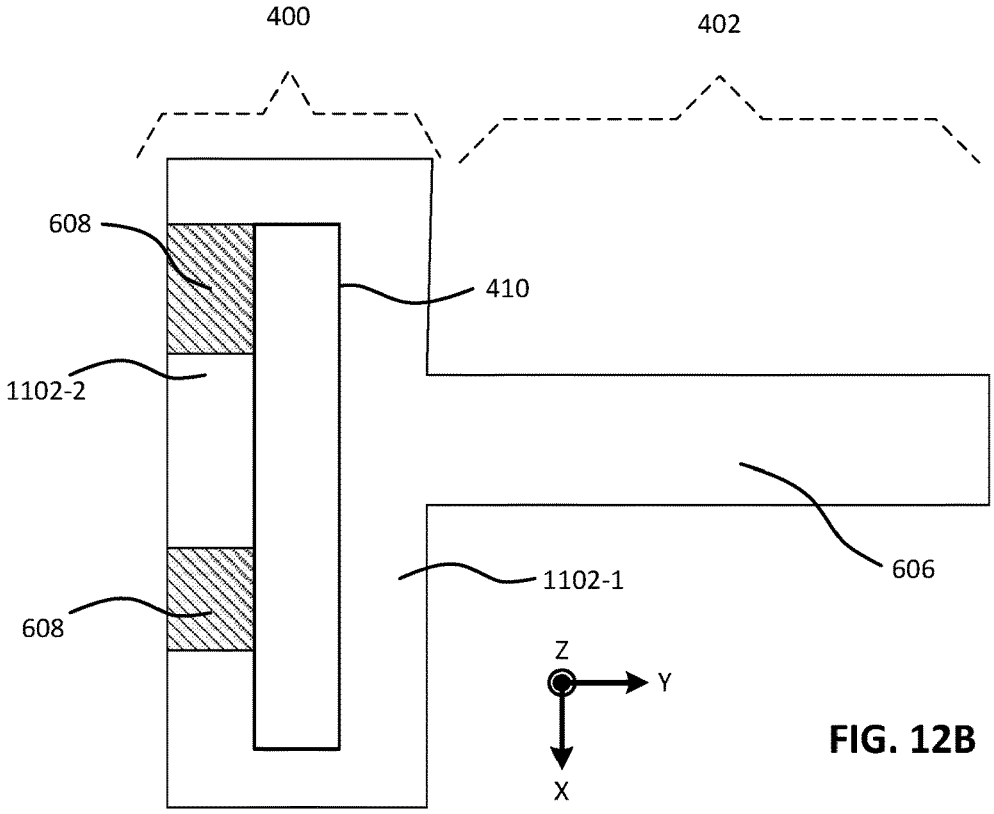

In one implementation, floating conductive plane 1102 is the same shape as (i.e., congruent with) cavity face 406. In other implementations, the shape of floating conductive plane 1102 is not the same as cavity face 406. For example, in one implementation, floating conductive plane 1102 may not completely surround slot 410. FIGS. 12A and 12B illustrate different shapes of top ground plane 606 in different implementations. In one implementation, floating conductive plane 1102 may be discontinuous. In FIG. 12A, floating conductive plane 1102 does not completely surround slot 410. Instead, floating conductive plane 1102 partially surrounds slot 410 and may be referred to as a "floating partial-perimeter loop." In FIG. 12B, floating conductive plane 1102 includes a floating partial perimeter loop 1102-1 and a segment 1102-2 that is not connected to the partial-perimeter loop segment 1102-1. As such, segment 1102-2 of conductive plane 1102 provides for a floating parasitic resonator for tuning antenna 400 and/or providing matching impedance. Segment 1102-2 may coincide with the conductive part of cavity face 406 (i.e., be directly above the conductive part of cavity face 406 even if not coextensive with the conductive part of cavity face 406). If feed 418 terminates beneath segment 1102-2, then feed 418 may be tied to cavity face 406 with a blind via so as to keep segment 1102-1 floating. In another implementation, feed 418 may be tied to both cavity face 406 and segment 1102-2. The placement and geometry of segment 1102-1 as a parasitic resonator can be selected to meet antenna performance goals.

Floating conductive plane 1102 may also have different widths or thicknesses as compared to cavity face 406. For example, floating conductive plane 1102 may be continuous around the entirely of slot 410, but be narrower than cavity face 406.

Returning to FIGS. 2 and 3, lumped components (not shown) may be placed (by solder, for example) near the interface between coaxial cable 202 and sidewall 208-1 of cavity 204 for impedance matching. Placing components in this area, however, may be difficult given the small space. With stripline 402, impedance matching components may alternatively (or additionally) be distributed within stripline 402. In implementations discussed below, features of stripline 402 (such as widening central conductor 602 and/or narrowing central conductor 602) may provide for impedance matching.

Figure 13:
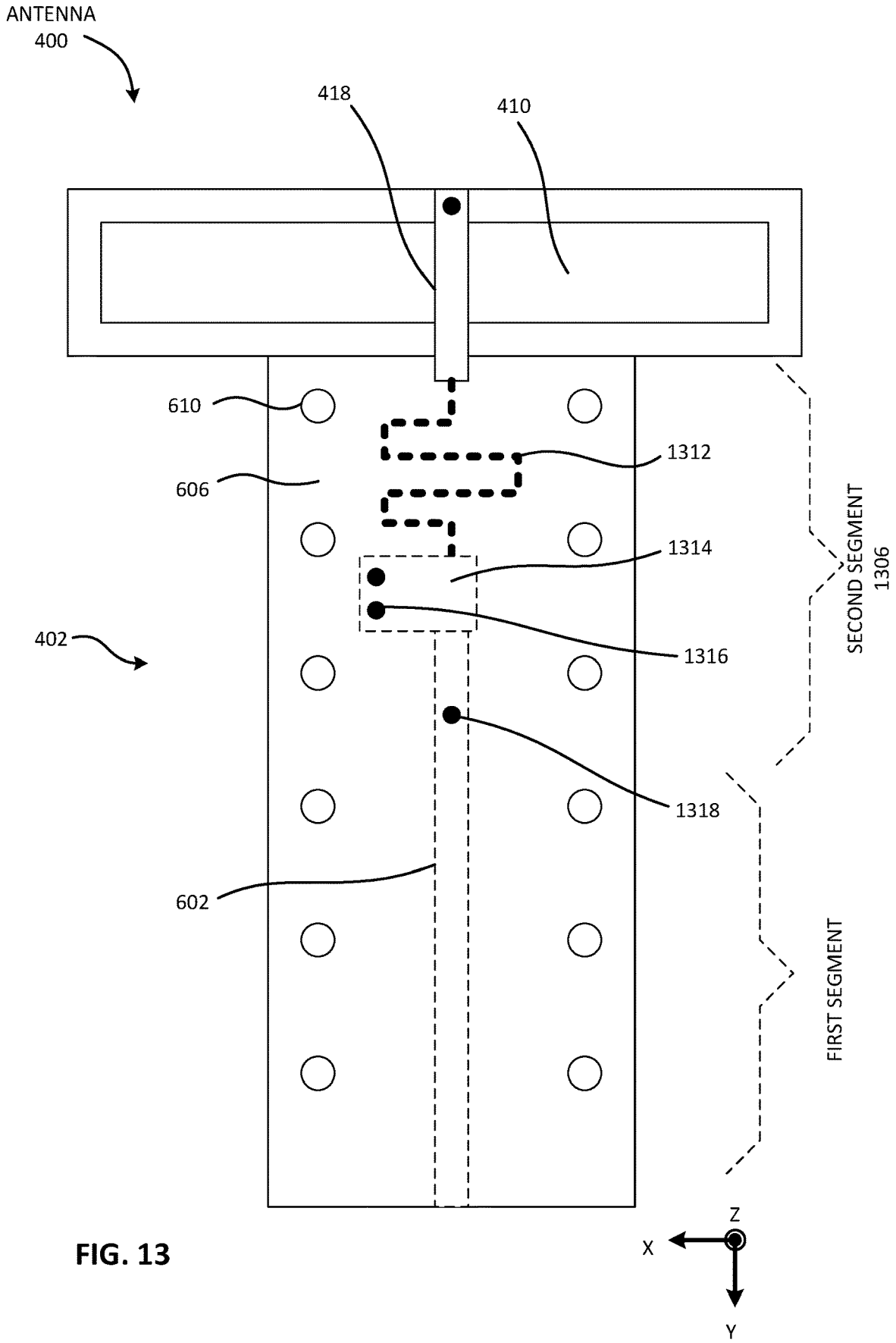
FIG. 13 illustrates an example implementation of a stripline with distributed matching components.

FIG. 13 illustrates an example implementation of distributed matching components in stripline 402 that feeds cavity-backed slot antenna 400. Antenna 400 includes feed 418 provided by stripline 402. In this example, feed 418 is tied to cavity face 406 at the far side of the slot 410. As shown, stripline 402 includes a first segment and a second segment 1306. Second segment 1306 is proximate antenna 400. Stripline 402 is generally shown in FIGS. 6A and 6B with the distributed components described herein. Central conductor 602 is shown with a dash line, as it resides beneath top ground plane 606. The first segment of stripline 402 provides a known characteristic impedance, such as 50 or 75 ohms. Second segment 1306 includes distributed components to provide a characteristic impedance to match the impedance to the load impedance of antenna 400. That is, the characteristic impedance of first segment is different than the characteristic impedance of the antenna (the load impedance).

Second segment 1306 includes a narrow central conductor 1312 (or "narrow conductor 1312"), which is narrow compared to central conductor 602. Narrow conductor 1312 may be used as a matching component, providing similar characteristics of that of an inductor. In this implementation, narrow conductor 1312 travels back and forth (or meanders or zig-zags). By zig-zagging, narrow conductor 1312 increases the electrical length relative to the corresponding length of second segment 1306 of stripline 402. In other implementations, narrow conductor 1312 does not meander or zig-zag.

Second segment 1306 also includes a wide central conductor 1314 (or "wide conductor 1314"), which is wider compared to central conductor 602. In this example, wide conductor 1314 includes one or more ground connections or vias 1316 at one end to tie wide conductor 1314 to top and/or bottom ground planes 604, 606. Other implementations may not include vias 1316. Wide conductor 614 may be used as a matching component, providing similar characteristics of that of a capacitor.

In one implementation, a lumped circuit component (e.g., an inductor, capacitor, and/or resistor (not shown)) may be tied to central conductor 602 by attaching the circuit component to via 1318 (which may pass through without contacting top ground plane 606 or bottom ground plane 604). Combinations of distributed and lumped components for matching impedance is possible. Including distributed matching components may allow for a narrower bezel, as compared to having lumped components, because lumped components may occupy more space. In addition, distributed matching components may not add to the thickness or the cost of stripline 402.

In addition to including impedance matching elements in stripline 402, matching elements (which may also be referred to as tuning elements) may be included in the structure of feed 418. For example, feed 418 may include an open-circuit stub (including a radial stub), a short-circuit stub, varying width stubs and lines, and/or any combination of these. Changing the structure of feed 418 allows the resonant frequency of the antenna to be controlled accordingly. Changing the structure of feed 418 also provides flexibility (with respect to the resonant frequency) not seen with coaxial cables, such as coaxial cable 202, for example. Because the structure pf feed 418 may be printed in the flexible circuit of stripline 402 and cavity face 406, the available geometries are greater than with a coaxial cable, for example.

The bandwidth and resonances of the antennas described above can be set by design by adjusting the location, lengths, and widths of feed 418. The bandwidth and resonances of the antennas can also be set by design by adjusting slot geometry and size and the geometry and size of the cavity.

FIGS. 14A through 14H illustrate an example implementation feed structures for cavity-backed slot antennas in different implementations. Antenna 1400A of FIG. 14A includes feed 1418A with a single segment that crosses slot 1410A to the opposite side of slot 1410A. Feed 1418A may or may not be tied (by one or more vias) to the cavity face at the distal end of feed 1418A. Different implementations of antenna 1400A and feed 1418A are described above. For example, the top ground plane from the stripline may cover the central conductor of the stripline to the edge of slot 1410A or only to sidewall 1408A-1 of antenna 1400A. The latter implementation may be referred to as a partial microstrip launch, discussed above. As discussed below, the feed may include other shapes, such as radial segments and/or tapered segments, for example. Any geometry for feed 418 may be printed in the flexible circuit.

Figure 14C:
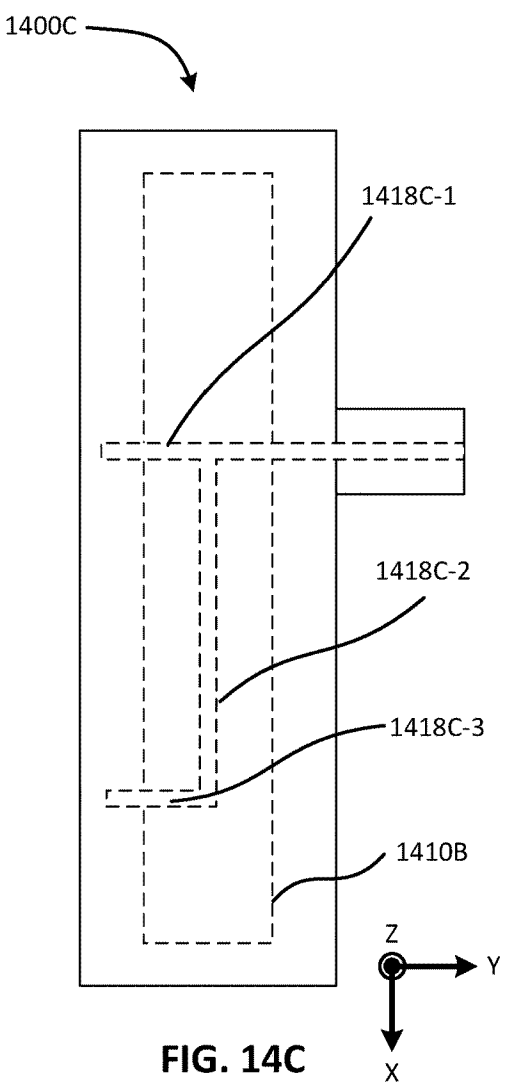
FIGS. 14A, 14B, 14C, 14D, 14E, 14F, 14G, and 14H illustrate implementations of feed structures and parasitic elements in the example implementation of the antenna of FIG. 4.
Figure 14B:
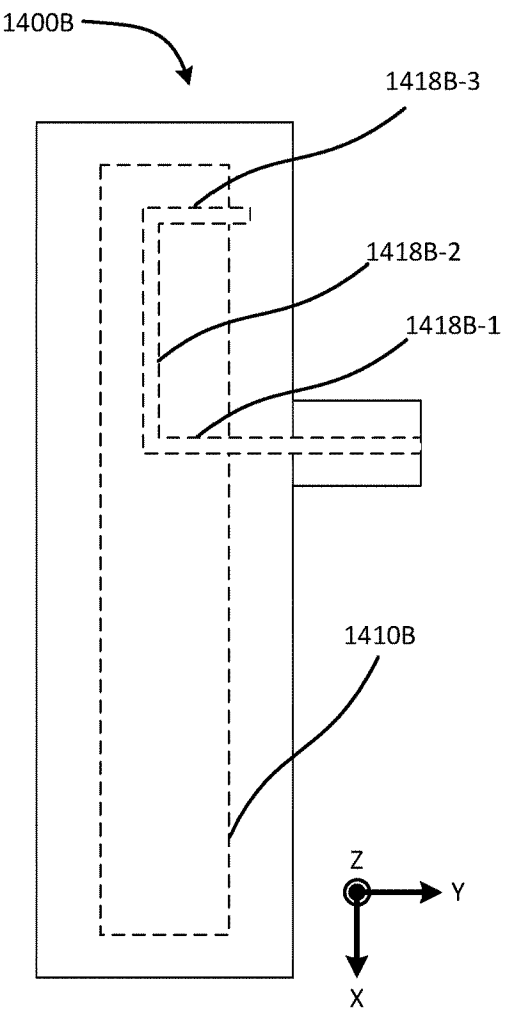
Figure 14A:
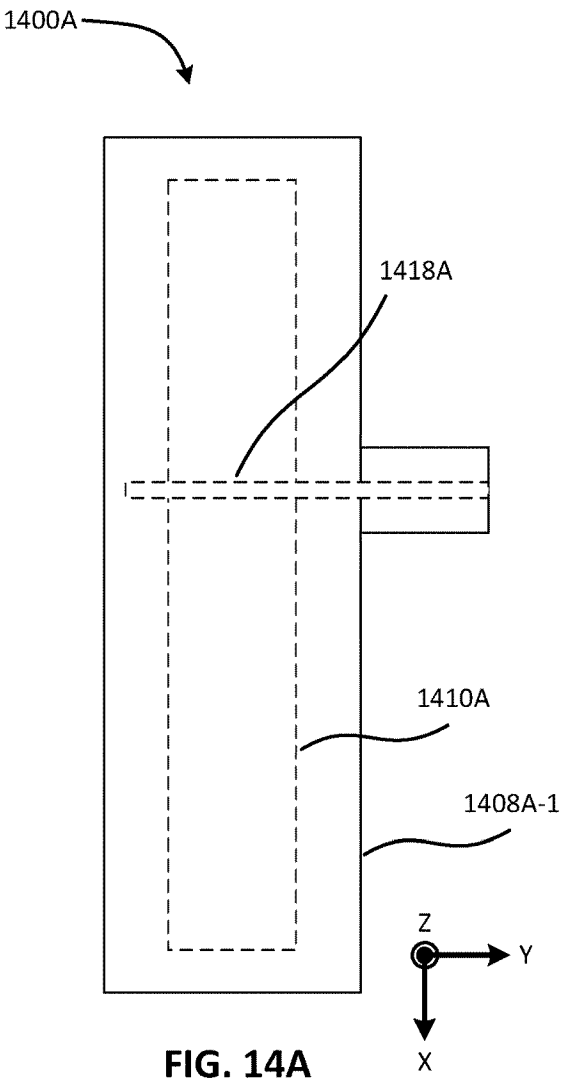

Antenna 1400B of FIG. 14B includes feed 1418B with three segments 1418B-1, 1418B-2, and 1418B-3. Feed 1418B does not cross slot 1410B to the opposite side of slot 1410B. Instead, feed 1418B returns (or loops back) to the same side of slot 1410A to a different location. Feed 1418B may be tied (by one or more vias) to the cavity face at the distal end of feed 1418B (at the location feed segment 1418B-3 returns over the cavity face).

Antenna 1400C of FIG. 14C includes feed 1418C also with three segments 1418C-1, 1418C-2, and 1418C-3. Like feed 1418A of FIG. 14A, feed 1418C also crosses slot 1410C to the opposite side of slot 1410C. Feed 1418C (segments 1418C-1 and 1418C-3) crosses slot 1410C in two different locations, giving feed 1418C two distal ends. Feed 1418C may be tied (by one or more vias) to the cavity face at one or both of the distal ends of feed 1418C (at either the location feed 1418C is over the cavity face, for example). Segment 1418C-2 protrudes in an orthogonal direction from segment 1418C-1. Segment 1418C-3 protrudes in an orthogonal direction from segment 1418C-2 (and in a parallel direction from segment 1418C-1) and reaches the far side of slot 1410C. The distance between the two distal ends of feed 1418C may be determined prior to printing the flexible circuit.

Figure 14F:
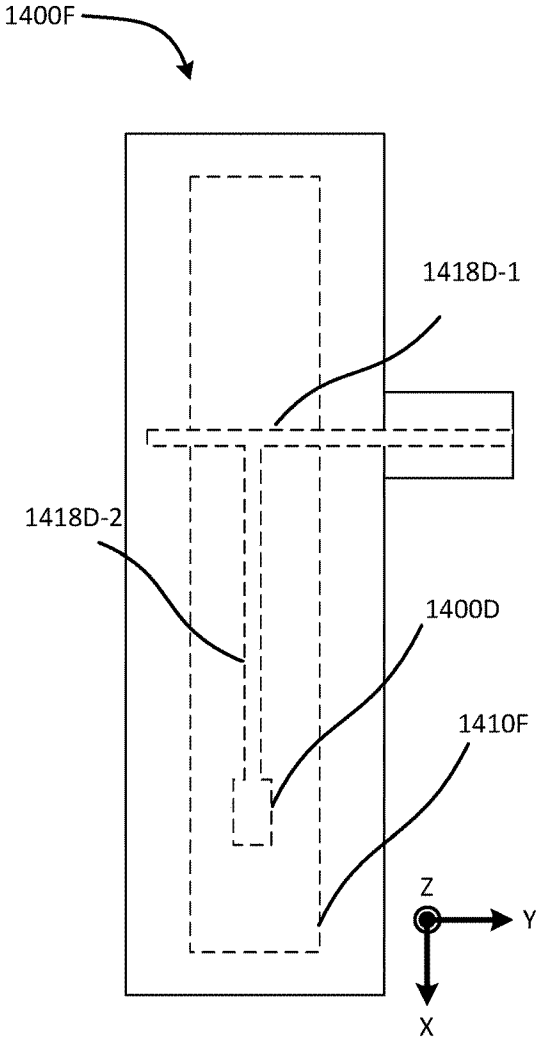
Figure 14E:
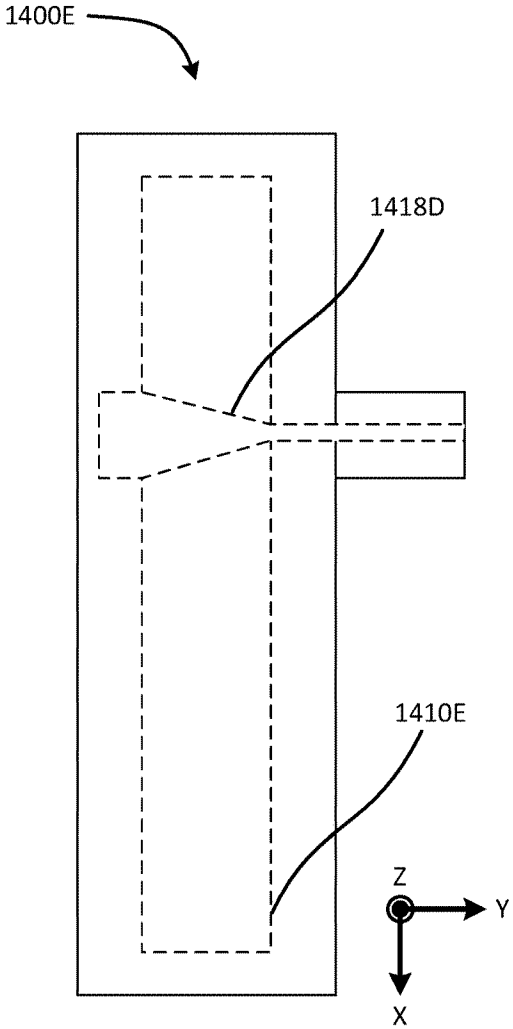
Figure 14D:
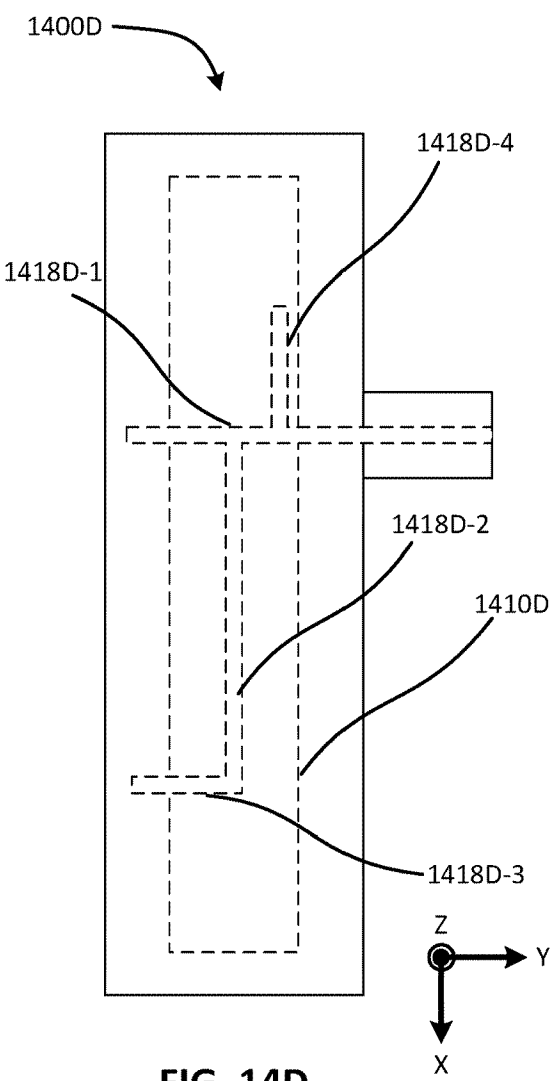

Antenna 1400D of FIG. 14D includes feed 1418D with four segments 1418D-1, 1418D-2, 1418D-3, and 1418C-4. Like feed 1418C of FIG. 14C, feed 1418D (segments 1418D-1 and 1418D-3) also crosses slot 1410D to the opposite side of slot 1410D in two different locations, giving feed 1418D two distal ends that cross slot 1410D. Feed 1418D may be tied (by one or move vias) to the cavity face at one or both of the distal ends of feed 1418D. Segment 1418D-2 protrudes in an orthogonal direction from segment 1418D-1. Segment 1418D-3 protrudes in an orthogonal direction from segment 1418D-2 (and in a parallel direction from segment 1418D-1) and reaches the far side of slot 1410D. Feed 1418D includes a third distal end in segment 1418D-4 that protrudes from segment 1418D-1 in an orthogonal direction from segment 1418D-1 (i.e., opposite from the direction of segment 1418D-2). Unlike segment 1418D-2, however, segment 1418D-4 is an open-circuit stub and does not return to a location over the cavity face and/or is not tied (i.e., by a via) to the cavity face.

Antenna 1400E of FIG. 14E includes feed 1418E with a single, tapered segment. Like feed 1418A of FIG. 14A, feed 1418E also crosses slot 1410E to the opposite side of slot 1410E. As feed 1418E crosses slot 1410E, its width increases toward its distal end. Feed 1418E may be tied (by one or more vias) to the cavity face at the distal end of feed 1418E (at the location feed 1418E is over the cavity face, for example). In one implementation, multiple vias in parallel may provide a lower inductance connection than a single via of the same diameter. In this implementation, the number and diameter of vias can be determined to optimize antenna match (i.e., tune the antenna by providing an inductive element).

Antenna 1400F of FIG. 14F includes feed 1418F with two segments 1418F-1 and 1418F-2. Like feed 1418C of FIG. 14C, feed 1418F also crosses slot 1410F to the opposite side of slot 1410F, giving feed 1418F a distal end on the other side of slot 1410F. Feed 1418F may be tied (by one or more vias) to the cavity face at the distal end of feed segment 1418F-1 (at the location feed 1418F-1 is over the cavity face, for example). Segment 1418F-2 protrudes in an orthogonal direction from segment 1418F-1. Unlike segment 1418F-1, however, segment 1418F-2 is an open-circuit stub in that it does not return to a location over the cavity face and/or is not tied (i.e., by one or more vias) to the cavity face. Second segment 1418F-2 also includes a wider portion at the end as an additional tuning element.

Figure 14H:
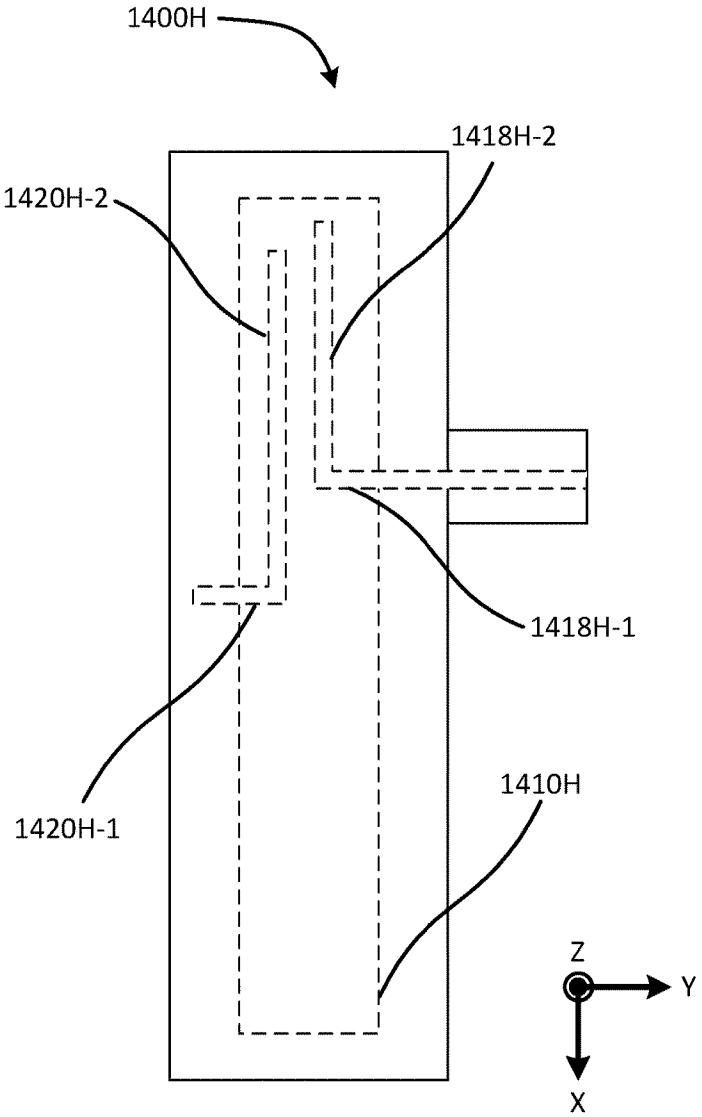
Figure 14G:
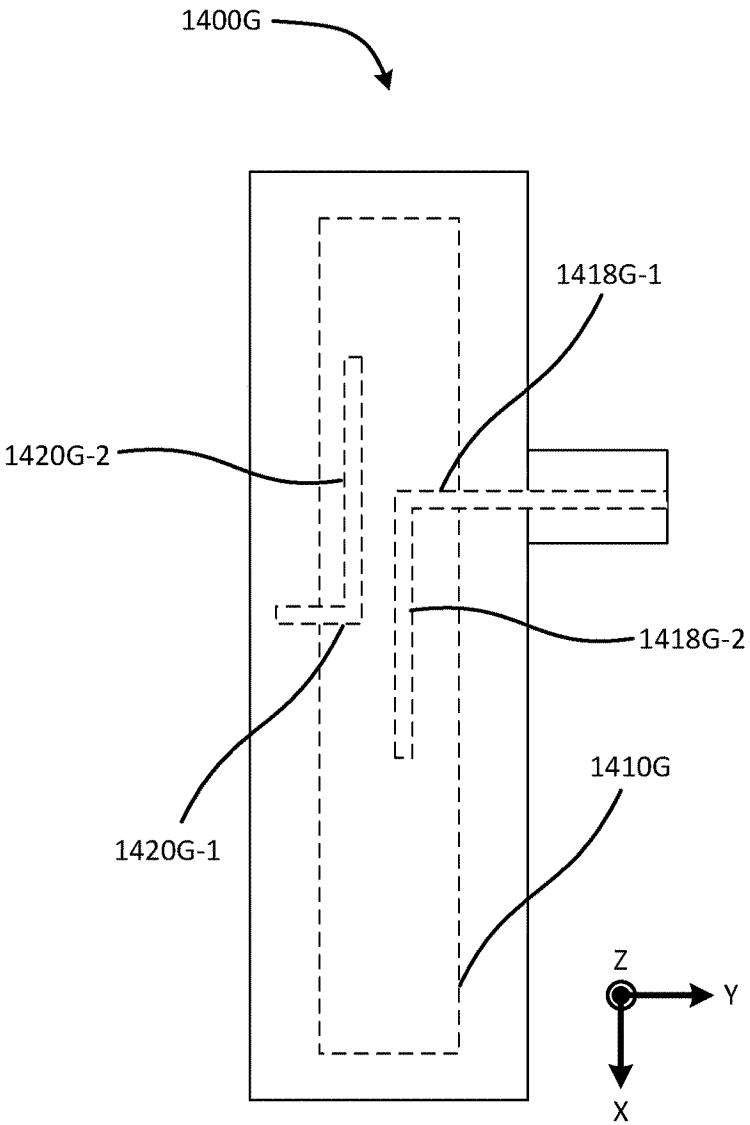

Antenna 1400G of FIG. 14G includes feed 1418G with two segments 1418G-1 and 1418G-2. Feed 1418G does not cross slot 1410G to the opposite side of slot 1410G. Instead, segment 1418G-2 extends in an orthogonal direction from segment 1418G-1 and does not return (or loop back) to the same side of slot 1410G at a different location. In this respect, feed 1418G is an open circuit feed. Antenna 1400G also includes a partially coupled parasitic resonator 1420G. Parasitic resonator 1420G includes a conductive strip having segments 1420G-1 and 1420G-2. First segment 1420G-1 extends from the cavity face opposite the location of feed 1418G. First segment 1420G-1 may be tied (by one or move vias) to the cavity face (at the location that parasitic resonator 1420G is over the cavity face). Second segment 1420G-2 extends in an orthogonal direction from first segment 1420G-1 and ends as an open circuit. In this implementation, portions of segment 1420G coincide with (i.e., are directly above) slot 1410G. Relative to segment 1418G-2 of feed 1418G, the second segment 1420G-2 of parasitic resonator 1420G extends in the opposite direction. Feed 1418G and parasitic resonator 1420G are not tied together in this example (although they may be somewhat coupled together by virtue of their proximity). This implementation exhibits multiple resonances, which can be changed depending on the geometry. This implementation enables a broad bandwidth antenna (such as 15%).

Antenna 1400H of FIG. 14H includes feed 1418H with two segments 1418H-1 and 1418H-2. Feed 1418H does not cross slot 1410H to the opposite side of slot 1410H. Instead, segment 1418H-2 extends in an orthogonal direction from segment 1418H-1 and does not return (or loop back) to the same side of slot 1410H at a different location. In this respect, feed 1418H is an open circuit feed. Antenna 1400H also includes a partially coupled parasitic resonator 1420H. Parasitic resonator 1420H includes a conductive strip having segments 1420H-1 and 1420H-2. First segment 1420H-1 extends from the cavity face opposite the location of feed 1418H. First element 1420H-1 may be tied (by one or move vias) to the cavity face (at the location that parasitic resonator 1420H is over the cavity face). Second segment 1420H-2 extends in an orthogonal direction from first segment 1420H-1 and ends as an open circuit. Relative to segment 1418H-2 of feed 1418H, the second segment 1420H-2 of parasitic resonator 1420H extends in the same direction (unlike the configuration of antenna 1400G). In this implementation, portions of segment 1420H coincide with (i.e., are directly above) slot 1410H. Feed 1418H and parasitic resonator 1420H are not tied together in this example, but they are more coupled together than in the implementation of FIG. 14G (antenna 1400G), for example. This implementation exhibits multiple resonances, which can be changed depending on the geometry. This implementation enables a broad bandwidth antenna (such as 19%).

Top ground plane 1406D from stripline 1402D of antenna 1400D may cover central conductor 1404D to the edge of slot 1410D or only to sidewall 1408D-1 of antenna 1400D.

The bandwidth and resonances of the antennas described in FIGS. 14A through 14H can be set by design by adjusting the location, lengths, and widths of the feeds and the resonators and the distance between feeds and resonators, for example. The bandwidth and resonances of these antennas can also be set by design by adjusting slot geometry and size and the geometry and size of the cavity. Examples of different a different slot geometry and cavity shape are described below.

Figure 15:
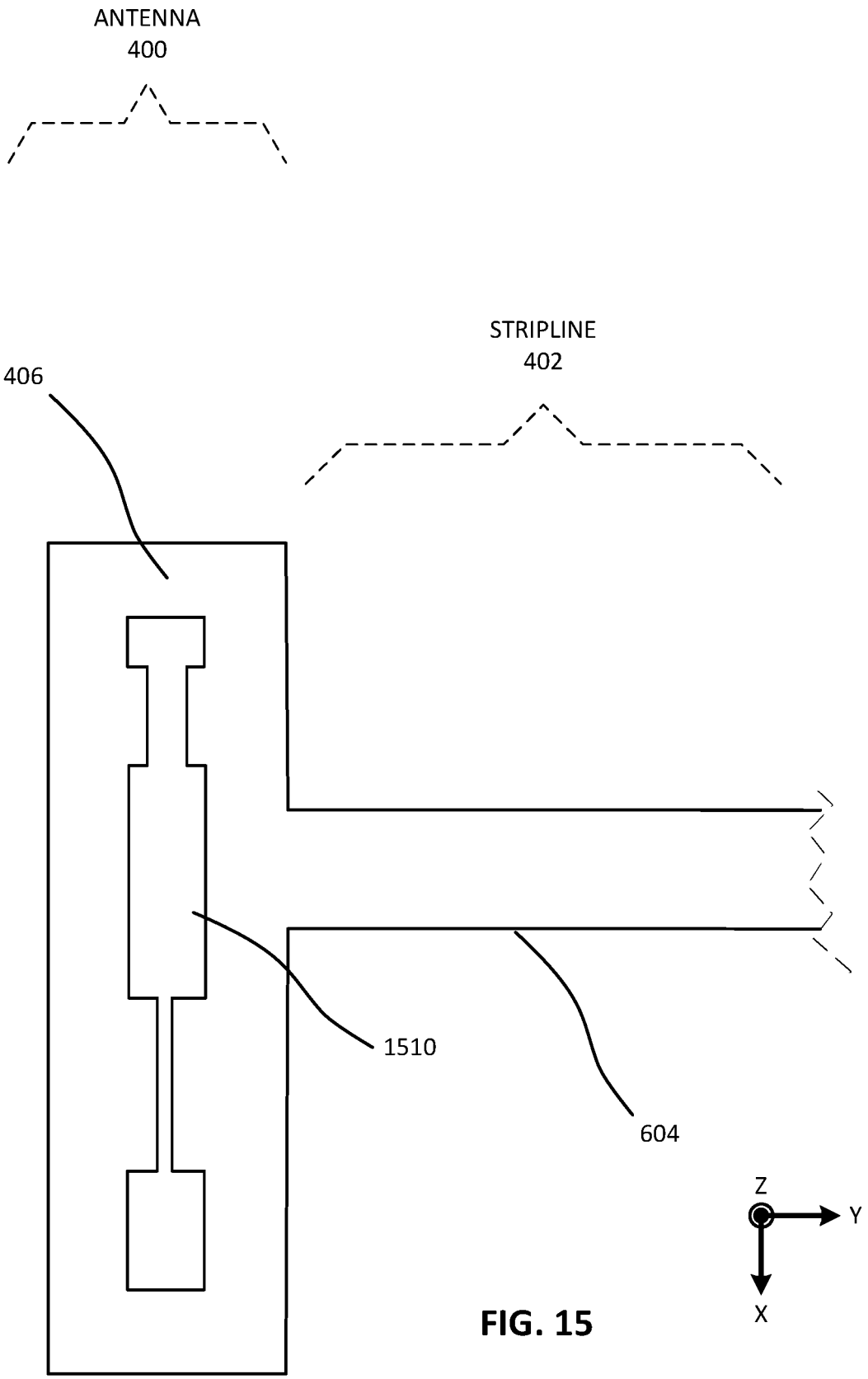
FIG. 15 illustrates example implementations of slot geometries for a cavity-backed slot antenna.

FIG. 15 illustrates a top conductor of a cavity-backed slot antenna 1500 in one implementation. The slot 1510 in antenna 1500 includes four segments 1510-1, 1510-2, 1510-3, 1510-4, and 1510-5, all of which form one continuous slot 1510. Segment 1510-1 is the same width as segment 1510-3 and 1510-5. Segment 1510-2 connects segment 1510-1 and 1510-3 and is narrower than those segments. Segment 1510-4 connects segments 1510-3 and 1510-5 and is narrow than those segments. Segment 1510-2 is also narrower than segment 1510-4.

Figure 16:
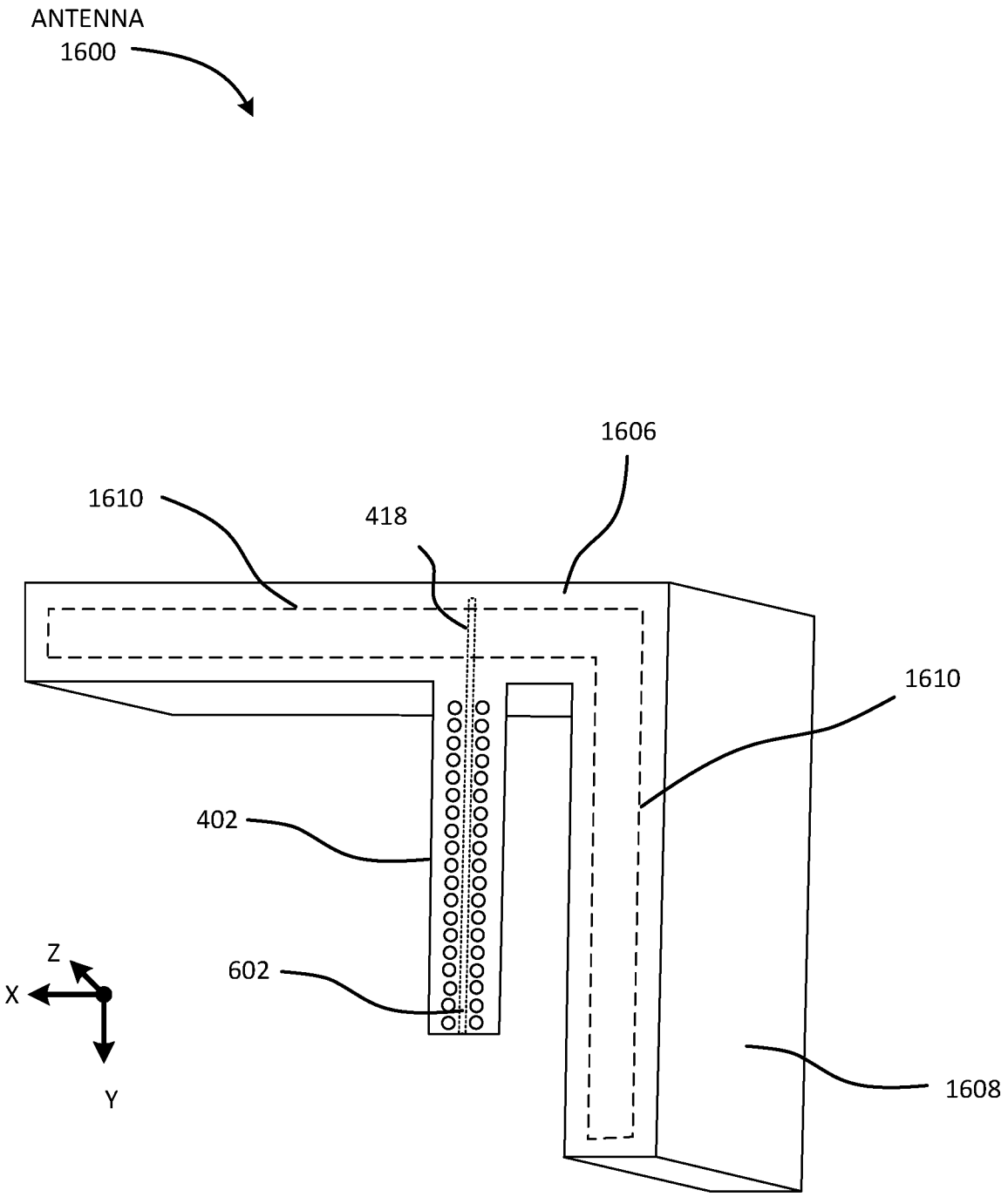
FIGS. 16, 17, 18, and 19 illustrates other example implementation of a cavity-backed slot antenna.

FIG. 16 illustrates a cavity-backed slot antenna 1600 in another implementation. As shown in FIG. 16, the cavity of antenna 1600 is L-shaped (as compared to rectangular). Antenna 1600 may be suitable for the corner of a display device between a display module and the housing of the device. Antenna 1600 is fed by stripline 402. Antenna 1600 includes a feed 418 that may be continuous with central conductor 602 of stripline 402. Feed 418 may take many different shapes, as discussed above. Cavity face 1606 of antenna 1600 conforms to the shape of the underlying cavity, i.e., L-shaped. In this implementation, slot 1610 may also generally conform to the shape of the cavity (i.e., L-shaped). As described above with respect to FIG. 15, slot 1610 may also have different geometries.

Figure 17:
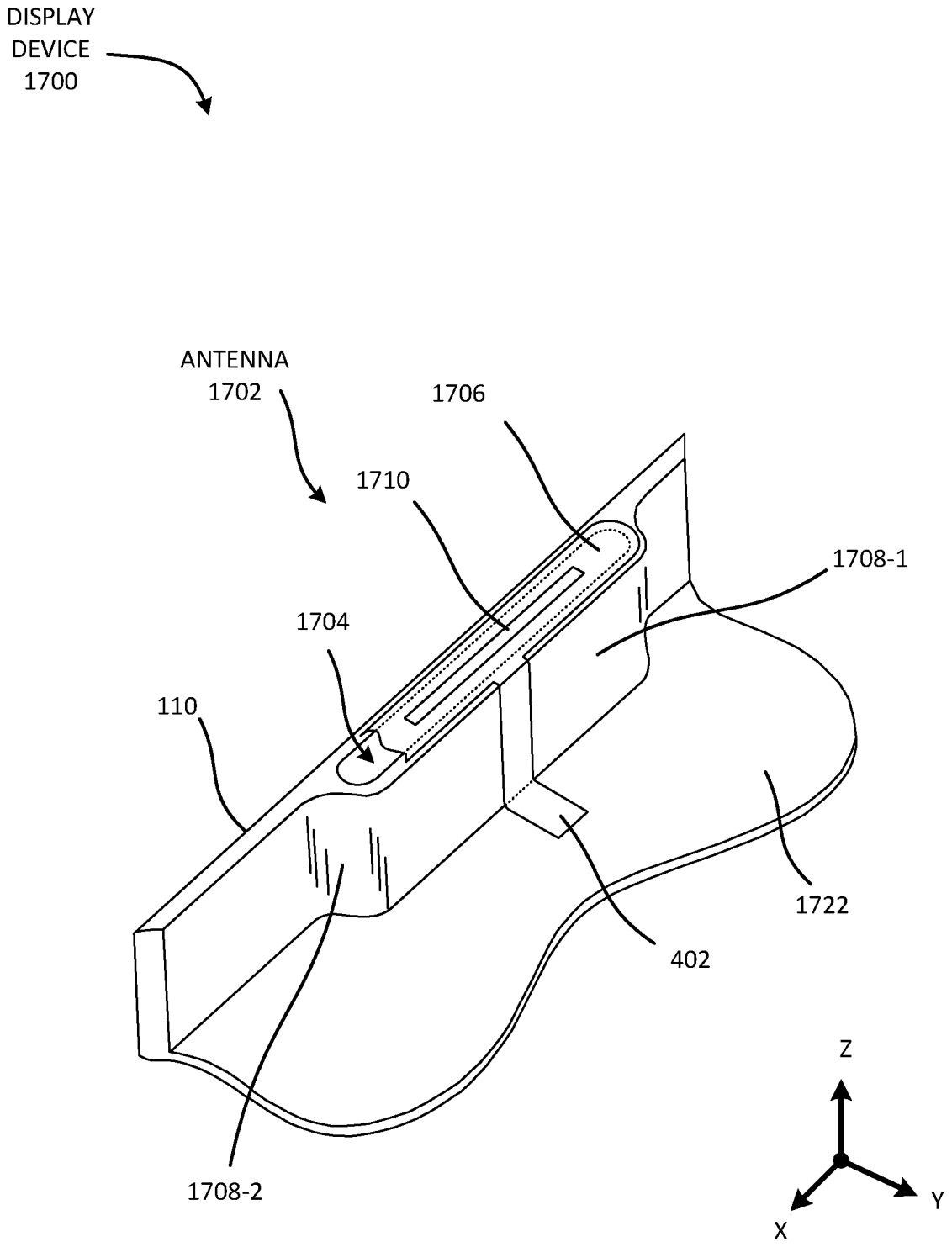

FIG. 17 illustrates a perspective view of a cavity-backed slot antenna 1702 in an implementation in which housing 110 of a display device 1700 forms one or more of the sidewalls of the cavity. For simplicity, display device 1700 in FIG. 17 does not show a display module or other electronic components of the device. Antenna 1702 includes a cavity 1704 surrounded by sidewalls including a conductive cavity face 1706 (i.e., a top conductor) and other sidewalls 1708 (two of which are referred to sidewall 1708-1 and sidewall 1708-2). Cavity face 1706 is partially cut away to show cavity 1704. Sidewalls 1708 are formed of conductive material (such as aluminum) and electrically coupled to cavity face 1706. In this implementation, cavity 1704 is milled directly into housing 110. Thus, housing 110 forms the sidewalls 1708 of antenna 1702 and provides structure and protection for the other components of display device 1700. Cavity face 1706 may be soldered to sidewalls 1708 to form cavity 1704 with slot 1710. In another implementation, cavity face 1706 may be adhered to sidewalls 1708 with a conductive adhesive. In either case, cavity face 1706 is connected to (including electrically connected to) sidewalls 1708.

This implementation may allow for additionally narrow bezel designs. Stripline 402 may bend from the cavity face 1706 to travel along sidewall 1708-1. Stripline 402 may bend again along the underside 1722 of housing 110 to reach circuitry (not shown). That is, the flexible circuit including stripline 402 and cavity face 1706 can be fit and connected to sidewalls 1708. Cavity face 1706 forms the top wall (top conductor) of antenna 1702. Cavity face 1706 includes and defines the geometry of a slot 410 with a rectangular aperture in this example. Other geometries of slot 410 are possible as discussed herein.

Figure 18:
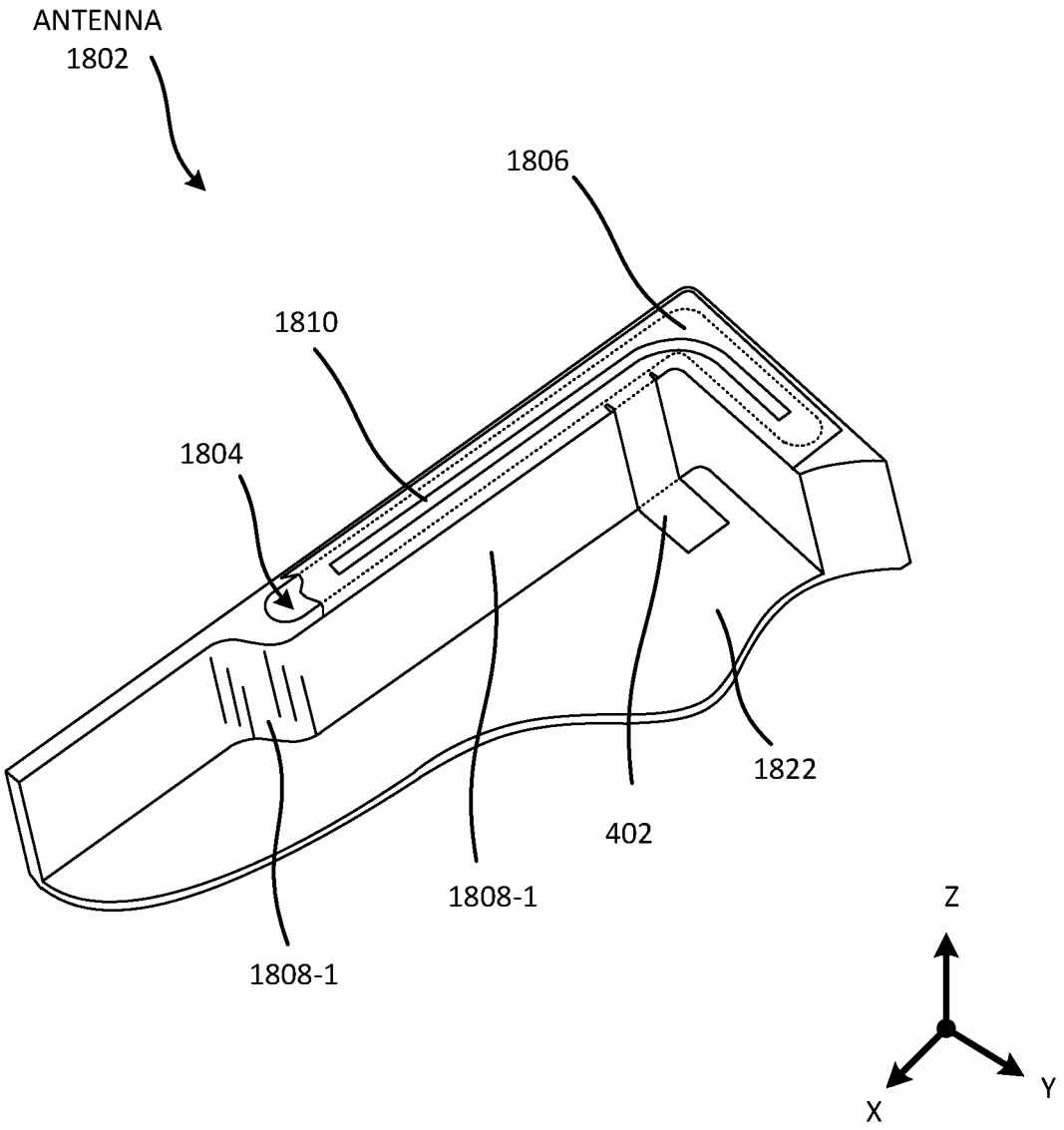

FIG. 18 illustrates a perspective view of another implementation of a cavity-backed slot antenna 1802 in which housing 110 of a display device 1800 forms one or more of the sidewalls of the cavity. Antenna 1802 includes a cavity 1804 surrounded by sidewalls including a conductive cavity face 1706 (i.e., a top conductor) and other sidewalls 1708 (two of which are referred to sidewall 1708-1 and sidewall 1708-2). Cavity face 1806 is partially cut away to show cavity 1804. Like antenna 1702, sidewalls 1808 are formed of conductive material (such as aluminum) and electrically coupled to cavity face 1806. In this implementation, cavity 1804 is milled directly into housing 110. Thus, housing 110 forms the sidewalls 1808 of antenna 1802 and provides structure and protection for the other components of display device 1900. Cavity face 1806 may be soldered to sidewalls 1808 to form cavity 1804 with slot 1810. In another implementation, cavity face 1806 may be adhered to sidewalls 1808 with a conductive adhesive.

This implementation may allow for additionally narrow bezel designs. Stripline 402 may bend from the cavity face 1806 to travel along sidewall 1808. Stripline 402 may bend again along the underside 1822 of housing 110 to reach circuitry (not shown). That is, the flexible circuit including stripline 402 and cavity face 1806 can be fit and connected to sidewalls 1708. Cavity face 1806 forms the top wall (top conductor) of antenna 1802. Cavity face 1806 includes and defines the geometry of a slot 410 with a rectangular aperture in this example. Other geometries of slot 1810 are possible as discussed herein.

Figure 19:
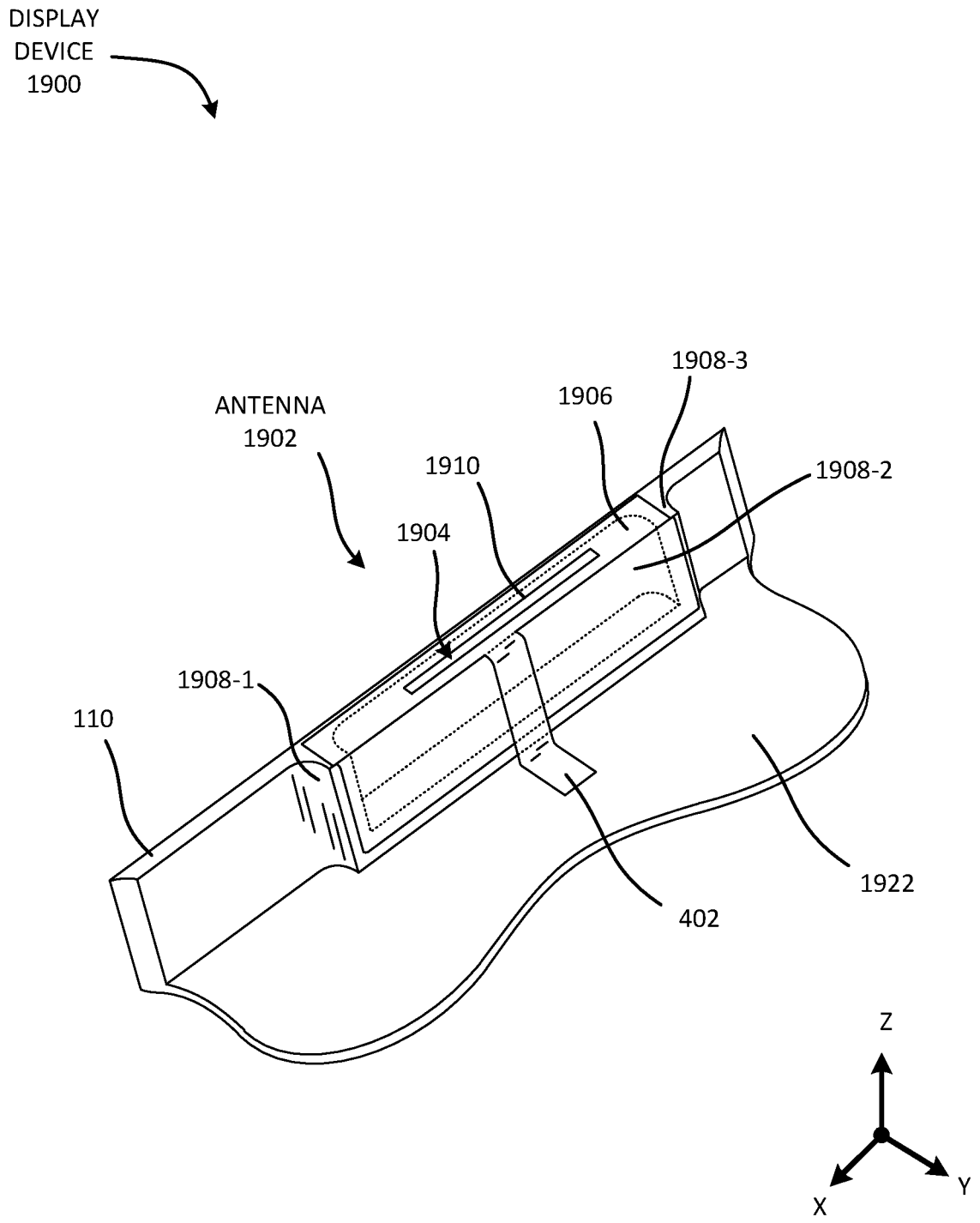

FIG. 19 illustrates a perspective view of another implementation of a cavity-backed slot antenna 1902 in which housing 110 of a display device 1900 forms one or more of the sidewalls of the cavity. Antenna 1902 includes a cavity 1904 surrounded by sidewalls 1908 including a conductive cavity face 1906 (i.e., a top conductor) and other sidewalls 1908 (two of which are referred to sidewall 1908-1 and sidewall 1908-2). In this implementation, sidewall 1908-2 is formed with a metallic closeout (such as a piece of formed sheet metal) that is attached to housing 110 (which forms part of the bezel) that provides electrical and mechanical bonding (such as with solder or a conductive adhesive). Cavity face 1906 is formed from a flexible circuit (such as a flexible printed circuit) that is also mechanically and electrically bonded to housing 110.

Four of sidewalls 1908 are formed of conductive material (such as aluminum) and electrically coupled to cavity face 1906. Two of these sidewalls are labeled in FIG. 19 as sidewall 1908-1 and 1908-3. The other two include the bottom sidewall (opposite cavity face 1906) and an exterior sidewall (opposite sidewall 1908-2 formed by a metallic closeout). In this implementation, cavity 1904 is milled directly into housing 110 (except sidewall 1908-2 which may include a metallic closeout). Thus, housing 110 forms the sidewalls 1908 of antenna 1902 and provides structure and protection for the other components of display device 1900. As with antennas 1802 and 1702, cavity face 1906 may be adhered to sidewalls 1908 (with a conductive adhesive) to form cavity 1904 with slot 1910. In another implementation, cavity face 1806 may be soldered to sidewalls 1908.

The implementation of FIG. 19 may allow for additionally narrow bezel designs. Stripline 402 may bend from the cavity face 1906 to travel along sidewall 1908-2. Formed from a metallic closeout (such as a piece of formed sheet metal), sidewall 1908-2 may be narrower than the implementation of FIG. 17 (i.e., milled aluminum). Stripline 402 may bend again along the underside 1922 of housing 110 to reach circuitry (not shown). That is, the flexible circuit including stripline 402 and cavity face 1906 can be fit and connected to sidewalls 1908. Cavity face 1906 forms the top wall (top conductor) of antenna 1902. Cavity face 1906 includes and defines the geometry of a slot 410 with a rectangular aperture in this example. Other geometries of slot 1910 are possible as discussed herein.

Cavities described herein may have a width of between, for example, 1 and 1.5 mm, 1.5 and 2 mm, 2 and 2.5 mm, 2.5 and 3 mm, or 3 and 3.5 mm. The cavity length may be, for example, 5 to 10 mm, 10 to 15 mm, 15 to 20 mm, 20 to 25 mm, 25 to 30 mm, or 30 to 35 mm. The cavity depth may be, for example, 5 to 10 mm, 10 to 15 mm, 15 to 20 mm, 20 to 25 mm, 25 to 30 mm, or 30 to 35 mm. Any combination of width, length, and depth of those listed above is possible. For example, in one implementation, antenna 400 may have a width of 3 mm (i.e., the y-direction), a height of 10 mm (i.e., in the z-direction), and a length of 20 mm (i.e., in the x-direction). Further, the cavity and/or antenna may be of other dimensions and still use the methods and systems described above.

In some implementations, the antennas described herein allow for the high-volume manufacture of cavity-backed slot-antennas in devices (such as display devices) with narrow bezels, such as a bezel width are of the order of 1 mm, 1.5 mm, 2 mm, 2.5 mm, 3 mm, and/or 3.5 mm. Other bezel and antenna dimensions are possible (larger or smaller than those mentioned). Further, designs discussed herein are suitable in devices other than those with displays, screens, and bezels. Further, antennas discussed herein may enable wireless functionality in a device, potentially with superior bandwidth, while addressing design criteria, such as a narrow bezel.

Figure 20A:
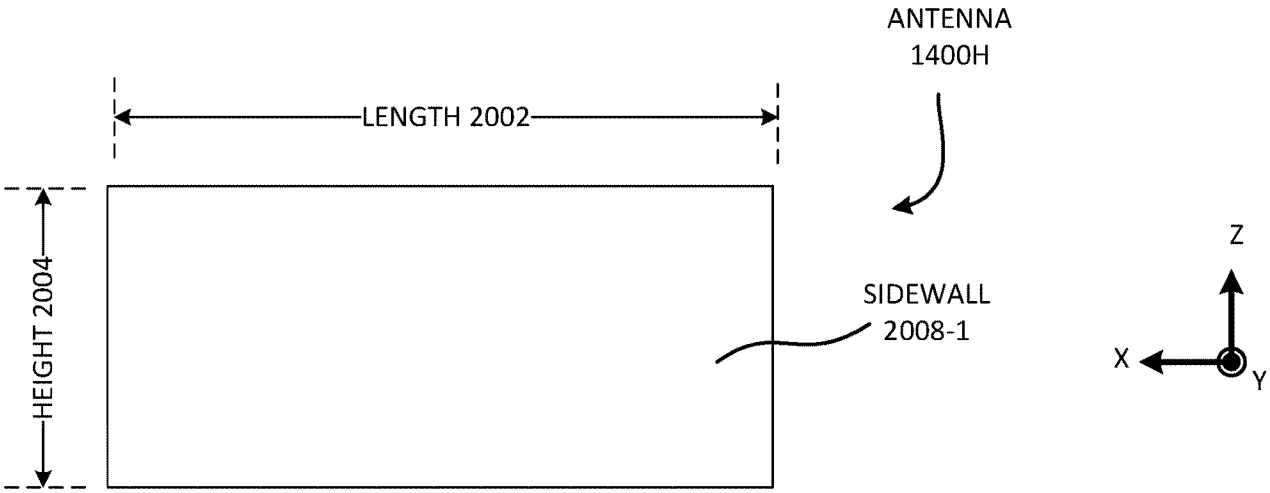
FIGS. 20A, 20B, and 20C illustrate example dimensions of the implementation of the feed structure and parasitic elements of the antenna of FIG. 14H.
Figure 20B:
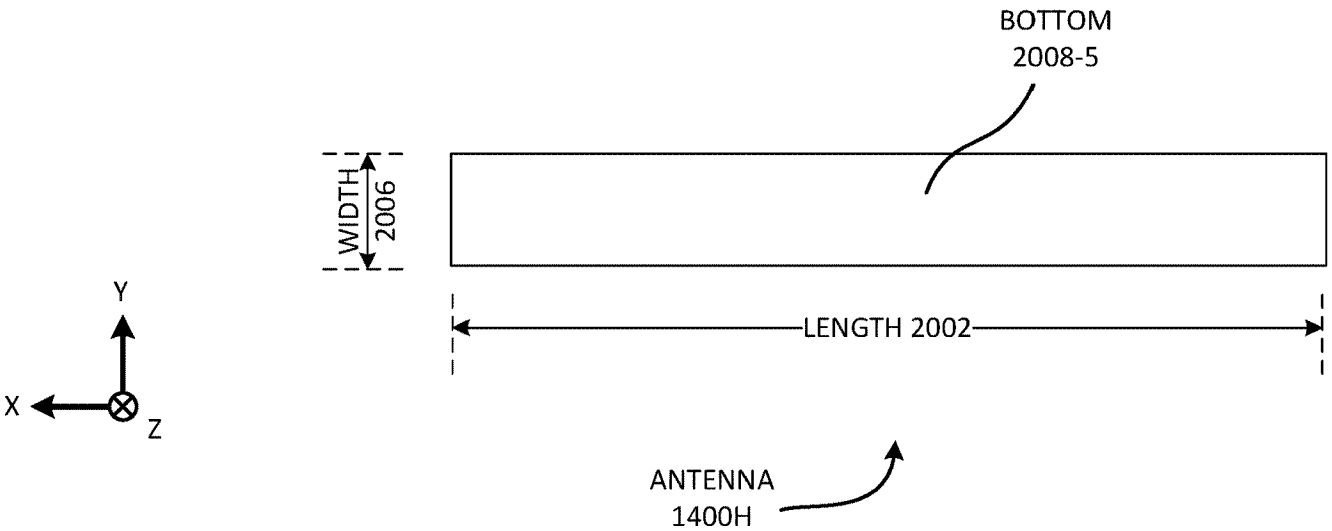
Figure 20C:
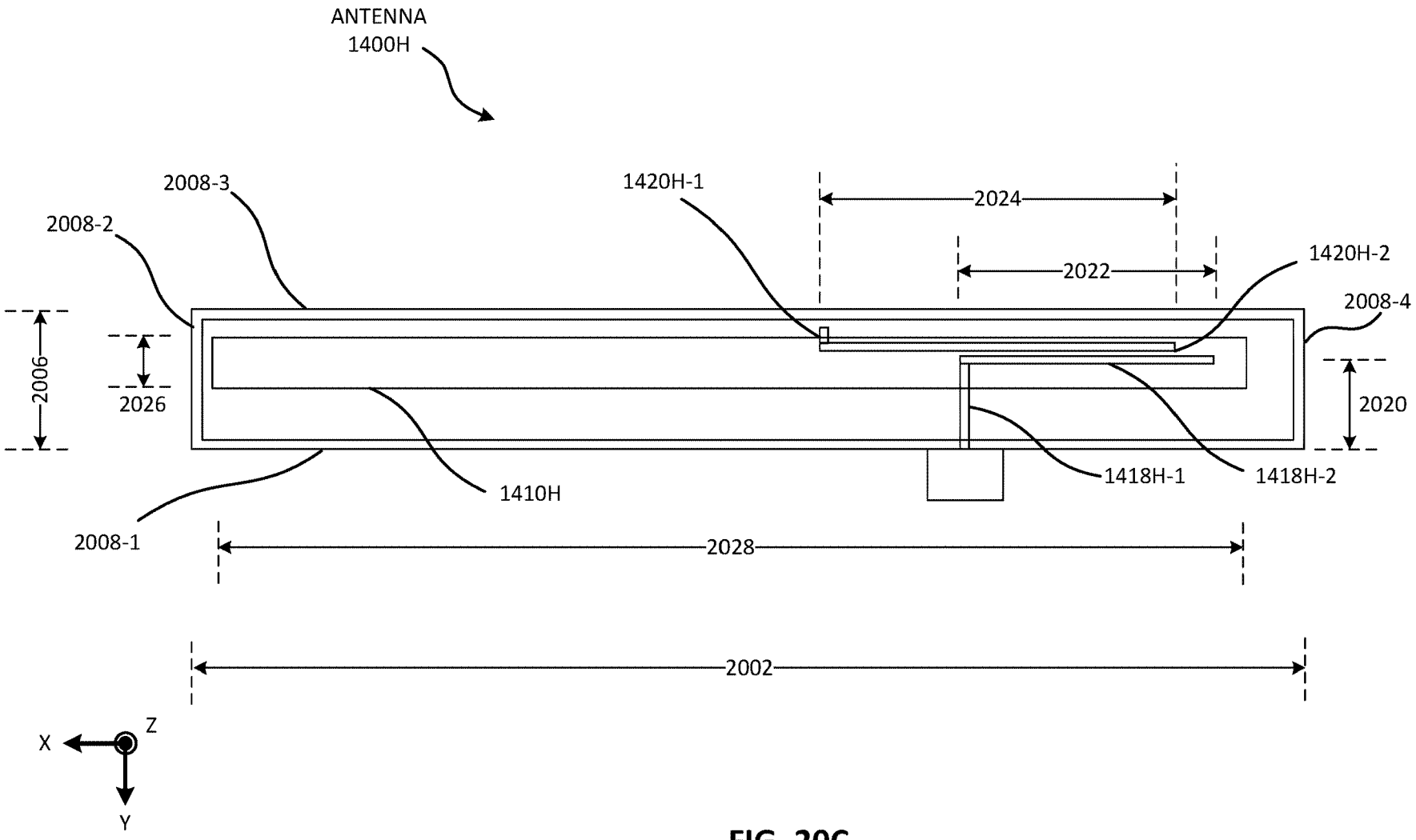

FIGS. 20A, 20B, and 20C illustrate example dimensions of antenna 1400H shown in FIG. 14H. More specifically, FIG. 20A shows antenna 1400H from the side (i.e., sidewall 2008-1); FIG. 20B shows antenna 1400H from the bottom (i.e., bottom 2008-5), and FIG. 20C shows antenna 1400H from the top. Referring to FIG. 20A, length 2002 of antenna 1400H (and thus sidewall 2008-1) is 22 mm in this implementation; and the height 2004 of antenna 1400H (and thus sidewall 2008-1) is 8 mm in this implementation. Referring to FIG. 20B, the width 2006 of antenna 1400H (and thus bottom 2008-5) is 2.70 mm in this implementation. In another implementation, width 2006 of antenna 1400H (and thus bottom 2008-5) is 2.77 mm. FIG. 20B also shows length 2002 of antenna 1400H (and thus bottom 2008-5), which is 22 mm in this implementation.

Referring to FIG. 20C, in this implementation, feed 1418H has a width of 0.2 mm; and resonator 1420 also has a width of 0.2 mm. Segment 1418H-1 of feed 1418H has a length 2020 of 1.7 mm; and segment 1418H-2 of feed 1418H has a length 2022 of 5 mm. Segment 1420H-2 of resonator 1420 has a length 2024 of 7 mm; and segment 1420-1 of resonator 1420 has a length of 0.5 mm. Slot 1410H has a width 2026 of 1 mm and a length 2028 of 20.5 mm. Sidewalls 2008 are 0.2 mm thick, and slot 1410H is spaced 1 mm from the interior of sidewall 2008-1; 0.3 mm from the interior of sidewall 2008-3; 1 mm from the interior of sidewall 2008-4; and 0.2 mm from the interior of sidewall 2008-2. The spacing of slot 1410H from the interior of sidewall 2008-1 and the interior of sidewall 2008-2 may be varied to accommodate the implementation in which width 2006 of antenna 1400H is 2.77 mm (as opposed to 2.70 mm).

The dimensions listed for antenna 1400H with respect to FIGS. 20A, 20B, and 2C are for example and approximate. Other dimensions are possible in other implementations.

Figure 21:
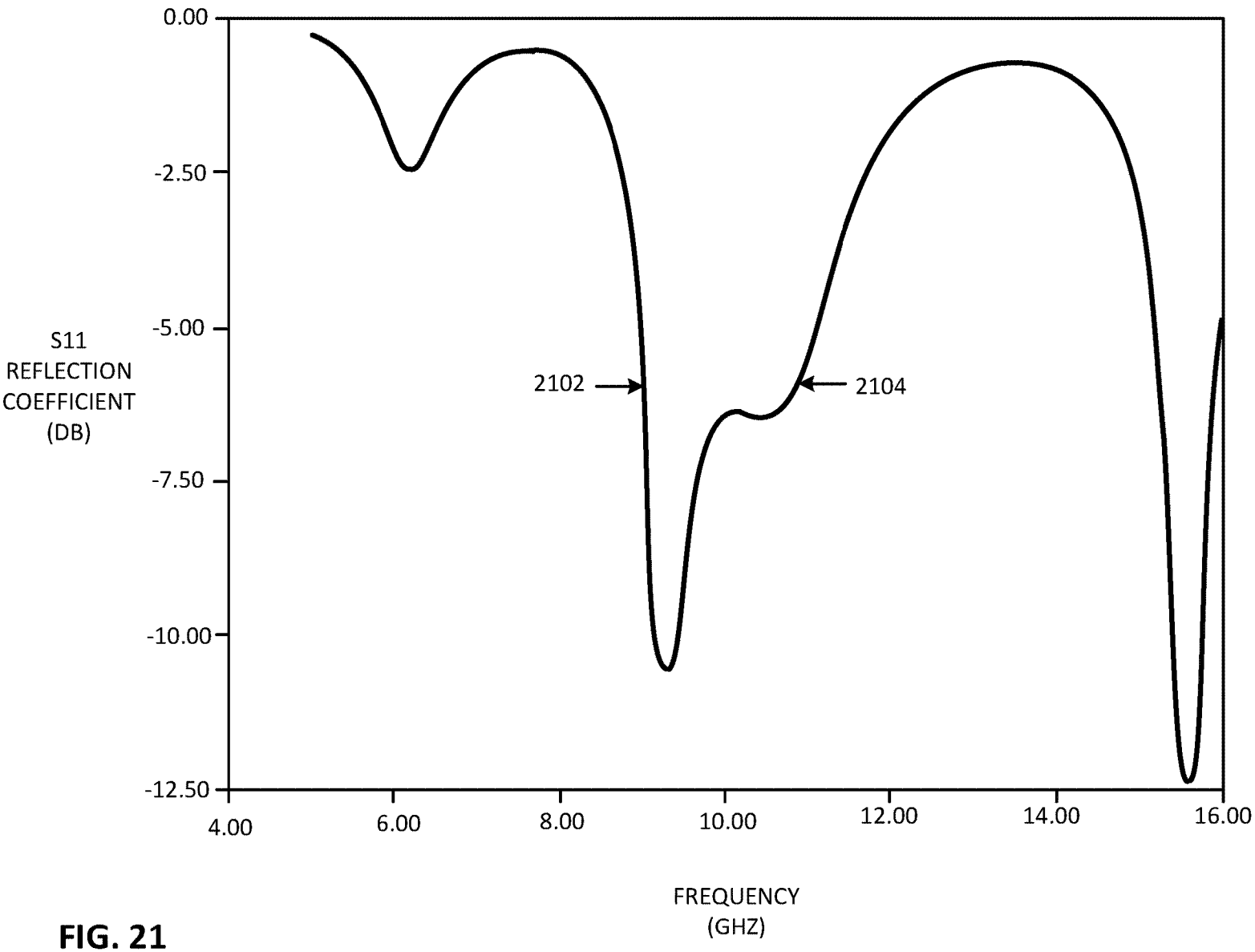
FIG. 21 is a plot of the reflection coefficient of the example implementation of the antenna of FIGS. 20A, 20B, and 20C.
Figure 22:
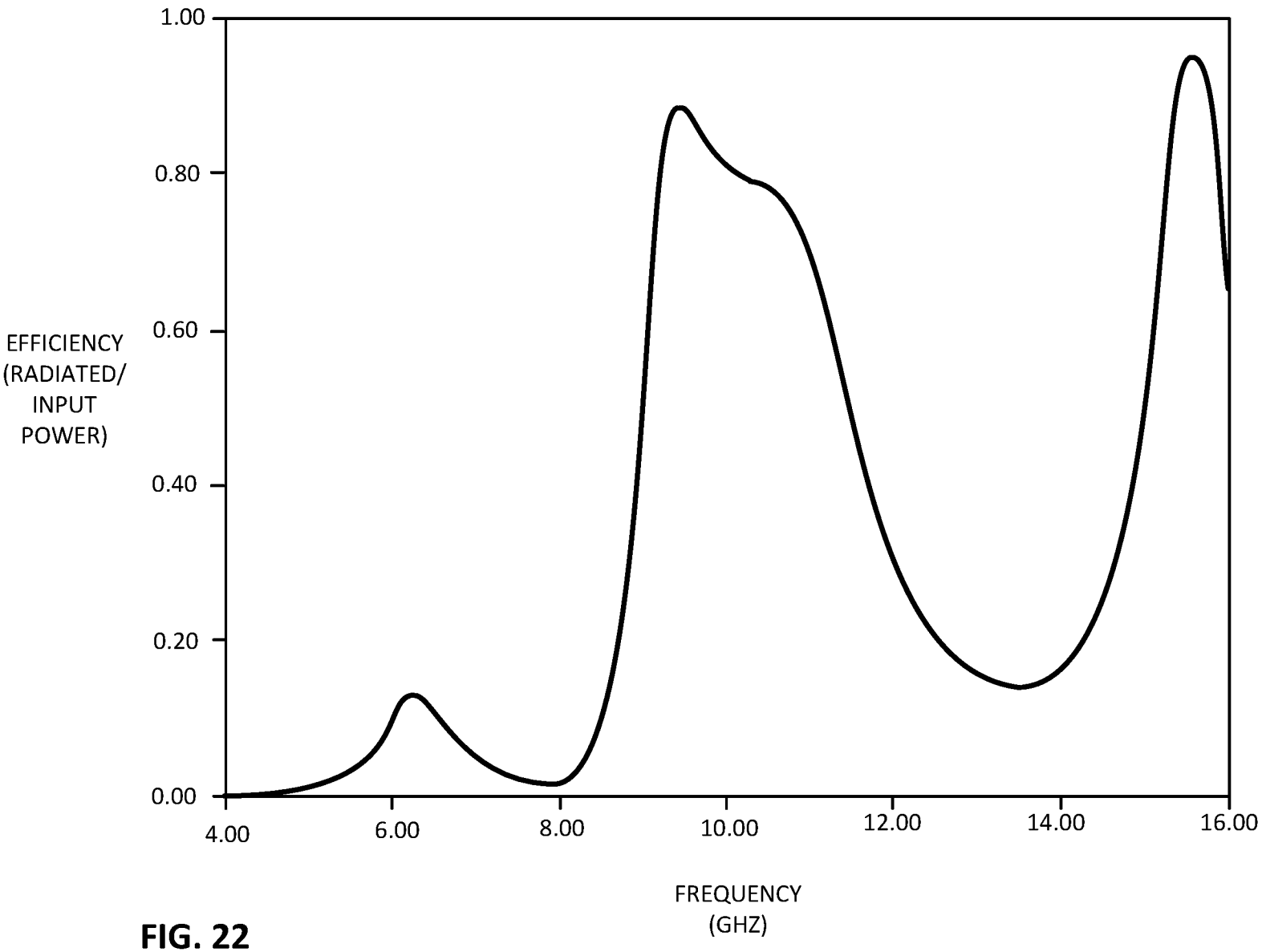
FIG. 22 is a plot of the efficiency of the example implementation of the antenna of FIGS. 20A, 20B, and 20C.

FIG. 21 is a plot of the reflection coefficient (i.e., the S11 scattering parameter) of the example implementation of antenna 1400H having the dimensions discussed with respect to FIGS. 20A, 20B, and 20C. Without additional matching elements, antenna 1400H achieves a bandwidth of 19% (i.e., bandwidth over the center frequency) near points 2102 (−5.9663 dB at 9.000 GHz) and 2104 (−5.8667 dB at 10.9000 GHz). Thus, this implementation may allow antenna 1400H to meet spectrum requirements (such as for radiolocation and/or presence detection) in many jurisdictions around the world. FIG. 22 is a plot of the efficiency of the example implementation of antenna 1400H having the dimensions discussed with respect to FIGS. 20A, 20B, and 20C. As shown, efficiency reaches a local maximum in the area of interest (such as between 9 and 11 GHz). Antenna 1400H may also meet the design goals of fitting into (or being incorporated into) a narrow bezel.

Figure 23:
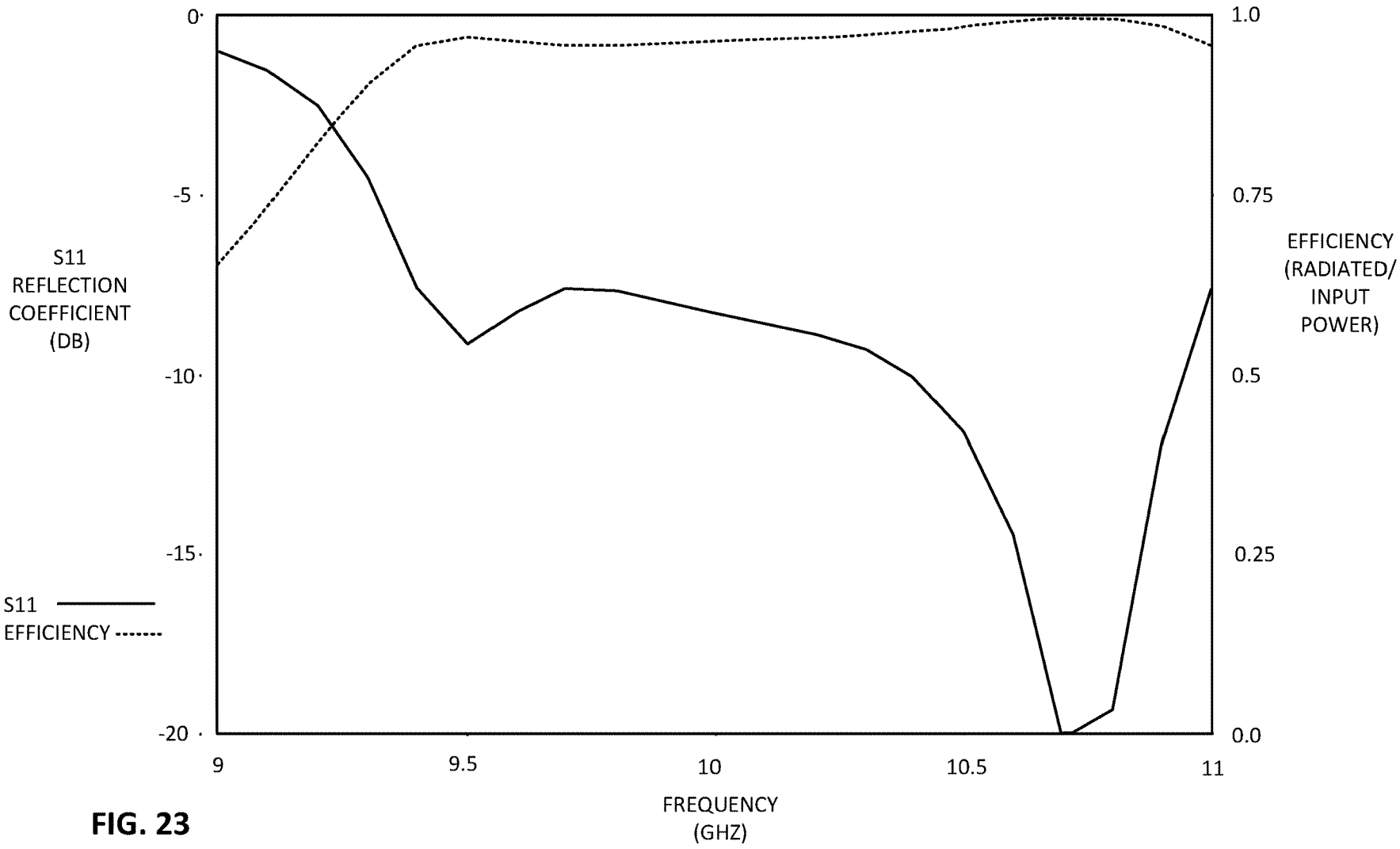
FIG. 23 is a plot of the reflection coefficient and the efficiency of the example implementation of the antenna of FIGS. 20A, 20B, and 20C with matching components.

With the addition of matching components (such as those discussed with respect to FIG. 13, improved performance may be achieved (relative to the performance shown in FIGS. 21 and 22) without necessarily having to increase the width of antenna 1400H and stripline. FIG. 23 is a plot of the reflection coefficient (i.e., the S11 scattering parameter) and the efficiency of antenna 1400H having the dimensions discussed with respect to FIGS. 20A, 20B, and 20C. As shown in FIG. 22, high efficiency is achieved between 9.4 and 11 GHz. Further, the reflection coefficient (S11) is less than −7 dB between 9.4 and 11 GHz.

Figure 24:
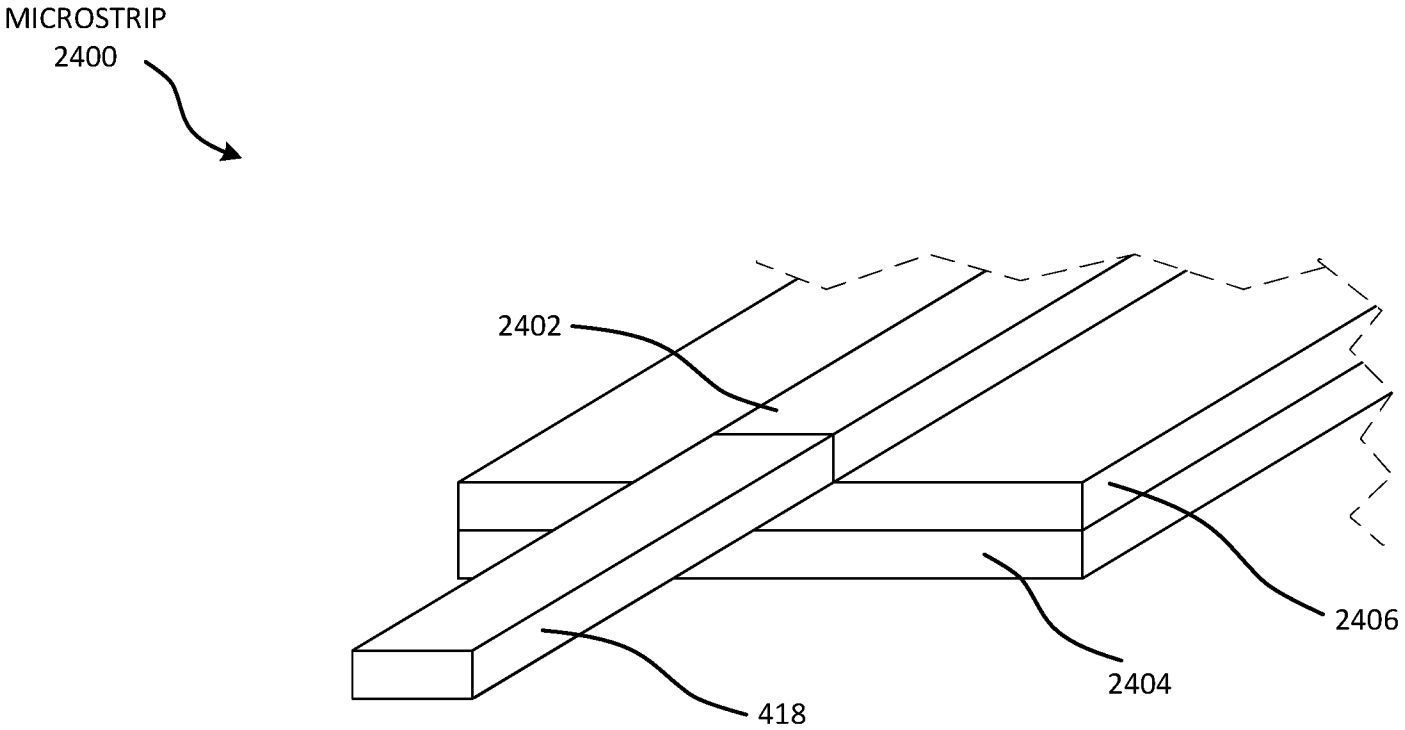
FIG. 24 is a perspective view of a microstrip in one implementation.

In other implementations, the three-layer stripline (i.e., stripline 402) could be replaced with a two-layer microstrip structure. A two-layer microstrip structure may be less desirable than a stripline in some circumstances. That is, the exposed microstrip (e.g., the center conductor) would be close to the active display module and could suffer losses and impedance variability. FIG. 24 illustrates an example implementation of microstrip 2400 having a conductive strip 2402 and a ground plane 2404 separated by an insulator 2406, such as a dielectric layer. Conductive strip 2402 corresponds in function to central conductor 602 (see FIG. 6A) of stripline 402. Like central conductor 602, conductive strip 2402 may extend to form feed 418. Microstrip 2400 can be used in the implementations described above instead of or in addition to stripline 402. As compared to a stripline, however, a microstrip may itself radiate and cause interference with surrounding components, or surrounding components interfere with the microstrip. Stripline 402 includes two layers of shielding as compared to the microstrip of FIG. 24. As a result, however, a microstrip may be less expensive to manufacture than a stripline. Microstrip 2400 may also be referred to as a "flexible printed circuit," a "flexible printed transmission line," or a "flexible planar transmission line."

Similar to stripline 402 shown in FIG. 13, microstrip 2400 may include a first segment and a second segment and distributed matching components. The second segment of microstrip 2400 may be proximate the antenna that it drives (i.e., antenna 400) and may include the distributed components similar to those described with respect to FIG. 13. That is, the first segment of microstrip 2400 may include a known characteristic impedance, such as 50 or 75 ohms. The second segment of stripline 2400 may include distributed components to provide a characteristic impedance to match the impedance to the load impedance of antenna 400. That is, the characteristic impedance of first segment is different than the characteristic impedance of the antenna (the load impedance).

The second segment of microstrip 2400 may include a narrow conductive strip, which is narrow compared to the conductive strip of the first segment. The narrow conductive strip may be used as a matching component, providing similar characteristics of that of an inductor. The narrow conductive strip may also travel back and forth (or meander or zig-zag). The second segment of microstrip 2400 may also include a wide conductive strip, which is wider compared to the conductive strip of the first segment. In one implementation, the wide conductive strip may include one or more ground connections or vias 1316 at one end to tie the wide conductive strip to the ground plane 2404. The wide conductive strip may be used as a matching component, providing similar characteristics of that of a capacitor.

In one implementation, a lumped circuit component (e.g., an inductor, capacitor, and/or resistor (not shown)) may be tied to conductive strip 2402 by attaching the circuit component to conductive strip 2402. Combinations of distributed and lumped components for matching impedance is possible. Including distributed matching components may allow for a narrower bezel, as compared to having lumped components, because lumped components may occupy more space. In addition, distributed matching components may not add to the thickness or the cost of microstrip 2400.

The bandwidth and resonances of the antennas described above can be set by design by adjusting the location, lengths, and widths of feed 418. The bandwidth and resonances of the antennas can also be set by design by adjusting slot geometry and size and the geometry and size of the cavity.

In the preceding specification, various preferred implementations are described with reference to the accompanying drawings. It will, however, be evident that various modifications and changes may be made thereto, and additional implementations may be implemented, without departing from the broader scope of the invention as set forth in the claims that follow. The specification and drawings are accordingly to be regarded in an illustrative rather than restrictive sense.

The invention claimed is:

1. A device comprising:

a cavity-backed slot antenna; and a flexible planar transmission line to feed the cavity-backed slot antenna, the flexible planar transmission line including:

a conductive strip separated from one or more ground planes by a dielectric, wherein the conductive strip feeds the cavity-backed slot antenna, a first segment having a first characteristic impedance, a second segment, proximate the cavity-backed slot antenna, having a second characteristic impedance, wherein the second characteristic impedance provides impedance for matching a load impedance of the cavity-backed slot antenna, and a flexible circuit, wherein the cavity-backed slot antenna includes a conductive sidewall formed by the flexible circuit.

2. The device of claim 1, wherein the conductive strip includes a first conductive strip and a second conductive strip, wherein the first segment includes the first conductive strip having a first width, and wherein the second segment includes the second conductive strip having a second width.

3. The device of claim 2, wherein the second width is larger than the first width.

4. The device of claim 3, wherein the second conductive strip includes a connection to one or both of the ground planes.

5. The device of claim 2, wherein the second width is smaller than the first width.

6. The device of claim 5, wherein the second conductive strip zig-zags to extend electrical length over the corresponding physical length.

7. The device of claim 1, wherein the flexible circuit defines a slot in the conductive sidewall of the cavity-backed slot antenna, and wherein the conductive sidewall formed by the flexible circuit is electrically connected to other conductive sidewalls of the cavity-backed slot antenna.

8. The device of claim 7, wherein the conductive sidewall formed by the flexible circuit is continuous with one of the ground planes of the flexible planar transmission line.

9. The device of claim 8, wherein the cavity-backed slot antenna includes a feed, wherein the feed is continuous with the conductive strip of the flexible planar transmission line.

10. The device of claim 9, wherein the flexible planar transmission line to feed the cavity-backed slot antenna includes a stripline, wherein the conductive strip separated from one or more ground planes is a central conductor separated from two ground planes, and wherein the feed emerges from the stripline proximate an edge of the slot of the cavity-backed slot antenna.

11. The device of claim 9, wherein the flexible planar transmission line to feed the cavity-backed slot antenna includes a stripline, wherein the conductive strip separated from one or more ground planes is a central conductor separated from two ground planes, and wherein the feed emerges from the stripline proximate an edge of the cavity-backed slot antenna at which the stripline meets the cavity-backed slot antenna.

12. The device of claim 8, wherein the flexible circuit includes a conductive plane that coincides with the conductive sidewall to act as a floating resonator.

13. The device of claim 8, wherein the flexible circuit includes a conductive strip that coincides with the slot to act as a resonator.

14. The device of claim 1, further comprising:

one or more lumped components electrically connected to the second segment wherein the lumped components provide impedance for matching the load impedance of the cavity-backed slot antenna.

15. A device comprising:

a display having a housing and a bezel;

a cavity-backed slot antenna situated within the bezel; and a flexible planar transmission line to feed the cavity-backed slot antenna, the flexible planar transmission line including:

a conductive strip separated from one or more ground planes by a dielectric, wherein the conductive strip feeds the cavity-backed slot antenna, a first segment having a first characteristic impedance, a second segment, proximate the cavity-backed slot antenna, having a second characteristic impedance, wherein the second characteristic impedance provides impedance for matching a load impedance of the cavity-backed slot antenna, and a flexible circuit, wherein the cavity-backed slot antenna includes a conductive sidewall formed by the flexible circuit.

16. The device of claim 1, wherein the conductive strip includes a first conductive strip and a second conductive strip, wherein the first segment includes the first conductive strip having a first width, wherein the second segment includes the second conductive strip having a second width, and wherein the second width is different than the first width or wherein the second conductive strip zig-zags to extend electrical length over the corresponding physical length.

17. The device of claim 15, a flexible circuit, wherein the cavity-backed slot antenna includes a conductive sidewall formed by the flexible circuit, wherein the conductive sidewall formed by the flexible circuit is electrically connected to other conductive sidewalls of the cavity-backed slot antenna, wherein the flexible circuit defines a slot in the conductive sidewall of the cavity-backed slot antenna, wherein the conductive sidewall formed by the flexible circuit is continuous with one of the ground planes of the flexible planar transmission line, and wherein the cavity-backed slot antenna includes a feed, wherein the feed is continuous with the conductive strip of the flexible planar transmission line.

18. The device of claim 9, wherein the flexible planar transmission line to feed the cavity-backed slot antenna includes a stripline, wherein the conductive strip separated from one or more ground planes is a central conductor separated from two ground planes, and wherein the feed emerges from the stripline proximate an edge of the slot of the cavity-backed slot antenna or wherein the feed emerges from the stripline proximate an edge of the cavity-backed slot antenna at which the stripline meets the cavity-backed slot antenna.

19. The device of claim 18, wherein the flexible circuit includes a conductive plane that coincides with the conductive sidewall to act as a floating resonator or wherein the flexible circuit includes a conductive strip that coincides with the slot to act as a resonator.

* * * * *